US011791150B2

(12) United States Patent
Cox et al.

(10) Patent No.: US 11,791,150 B2
(45) Date of Patent: Oct. 17, 2023

(54) TOF QUALITATIVE MEASURES USING A MULTICHANNEL DETECTOR

(71) Applicant: DH TECHNOLOGIES DEVELOPMENT PTE. LTD., Singapore (SG)

(72) Inventors: David Michael Cox, Toronto (CA); Nic G. Bloomfield, Newmarket (CA)

(73) Assignee: DH Technologies Development Pte.Ltd., Singapore (SG)

( * ) Notice: Subject to any disclaimer, the term of this patent is extended or adjusted under 35 U.S.C. 154(b) by 175 days.

(21) Appl. No.: 17/310,959

(22) PCT Filed: Apr. 15, 2020

(86) PCT No.: PCT/IB2020/053540

§ 371 (c)(1),
(2) Date: Sep. 2, 2021

(87) PCT Pub. No.: WO2020/212856

PCT Pub. Date: Oct. 22, 2020

(65) Prior Publication Data

US 2022/0199390 A1 Jun. 23, 2022

Related U.S. Application Data

(60) Provisional application No. 62/834,234, filed on Apr. 15, 2019.

(51) Int. Cl.

| | |
|---|---|
| ***H01J 49/40*** | (2006.01) |
| ***H01J 49/00*** | (2006.01) |
| ***H01J 49/02*** | (2006.01) |

(52) U.S. Cl.
CPC ..... *H01J 49/40* (2013.01); *H01J 49/0036* (2013.01); *H01J 49/025* (2013.01)

(58) Field of Classification Search
CPC ..... H01J 49/40; H01J 49/0036; H01J 49/025
(Continued)

(56) References Cited

U.S. PATENT DOCUMENTS

2003/0111597 A1* 6/2003 Gonin ..... H01J 49/025 250/397
2005/0006577 A1* 1/2005 Fuhrer ..... H01J 49/025 250/287

(Continued)

FOREIGN PATENT DOCUMENTS

WO 2005010799 A2 2/2005
WO 2017158534 A1 9/2017

OTHER PUBLICATIONS

International Search Report and Written Opinion for PCT/IB2020/053540, dated Jul. 23, 2020.

*Primary Examiner* — Kiet T Nguyen
(74) *Attorney, Agent, or Firm* — Kasha Law LLC; John R. Kasha; Kelly L. Kasha

(57) ABSTRACT

The resolution of a TOF mass analyzer is maintained despite a loss of resolution in one or more channels of a multichannel ion detection system by selecting the highest resolution channels for qualitative analysis. Ion packets that impact a multichannel detector are converted into multiplied electrons and emitted from two or more segmented electrodes that correspond to impacts in different regions across a length of the detector. The electrons received by each electrode of the two or more segmented electrodes for each ion packet are converted into digital values in a channel of a multichannel digitizer, producing digital values for at least two or more channels. Qualitative information about the ion packets is calculated using digital values of a predetermined subset of one or more channels of the at least two or more channels known to provide the highest resolution.

15 Claims, 16 Drawing Sheets

(58) Field of Classification Search
USPC ..... 250/287, 397
See application file for complete search history.

(56) References Cited

U.S. PATENT DOCUMENTS

| | | | | |
|---|---|---|---|---|
| 2006/0289747 | A1 | 12/2006 | Schultz et al. | |
| 2009/0189072 | A1* | 7/2009 | Egan | G01N 23/2206 250/282 |
| 2011/0024620 | A1* | 2/2011 | Hidalgo | H01J 49/0027 250/282 |
| 2011/0147578 | A1 | 6/2011 | Schultz et al. | |
| 2011/0186727 | A1 | 8/2011 | Loboda | |

* cited by examiner

800

1500

TOF QUALITATIVE MEASURES USING A MULTICHANNEL DETECTOR

RELATED APPLICATIONS

This application claims the benefit of U.S. Provisional Patent Application Ser. No. 62/834,234, filed on Apr. 15, 2019, the content of which is incorporated by reference herein in its entirety.

INTRODUCTION

The teachings herein relate to an ion detection system for a time-of-flight (TOF) mass analyzer or mass spectrometer. More particularly, the teachings herein relate to a multichannel ion detection system that uses the signal intensity detected in the highest resolution channels for qualitative analysis but uses the signal intensity of the highest resolution channels and lower resolution channels for quantitative analysis.

The systems and methods disclosed herein are also performed in conjunction with a processor, controller, microcontroller, or computer system, such as the computer system of FIG. 1.

BACKGROUND

Currently, some conventional TOF mass analyzers use ion detection systems that include four-channel digitizers. A four-channel digitizer can include either a time-to-digital converter (TDC) or an analog-to-digital converter (ADC), for example. Multichannel ion detection systems provide two main benefits: enhanced dynamic range and improved resolution through independent calibration of channels (also known as channel alignment).

The use of analog detection can in principle replace the need for multiple channels from a dynamic range aspect, which may also result in better timing resolution of an ADC. However, the channel alignment benefit would disappear. This can be partially compensated for by various means of tilting either the ion packet or detector itself, but it does not remove the adverse effect of the ion packet curvature on resolution. Therefore, four-channel ADCs have conventionally been used.

Resolution on a TOF mass analyzer is a key driver of instrument performance. In a TOF ion detection system, resolution essentially refers to how well the distance between ion packets can be measured. In other words, the highest resolution would be the minimum distance between two ion packets where those two different ion packets could still be resolved.

Unfortunately, over time, the resolution of a TOF mass analyzer can degrade until it is no longer acceptable for a customer. For a multichannel TOF mass analyzer, the resolution of some channels can degrade faster and greater than other channels. For example, in a four-channel TOF mass analyzer, the resolutions measured by the two channels receiving data from the two outermost electrodes typically degrade faster than the resolutions measured by the two channels receiving data from the two innermost electrodes.

Simply discarding data from any channel with a degraded resolution may appear, at first, to be a solution to this problem. However, discarding the signal of even a single channel can reduce the overall sensitivity of the TOF mass analyzer and defeat the original purpose of using a multichannel ion detection system.

As a result, additional systems and methods are needed to address the problem of degraded resolution in some channels of a multichannel ion detection system of a TOF mass analyzer.

SUMMARY

A system, method, and computer program product are disclosed for maintaining the resolution of a TOF mass analyzer despite a loss of resolution in one or more channels of a multichannel ion detection system of the TOF mass analyzer. The system includes a multichannel detector and electron multiplier, a multichannel digitizer, and a processor.

The multichannel detector and electron multiplier is impacted by ion packets of a TOF mass analyzer. Ion packets impact a first side of the multichannel detector and electron multiplier. The multichannel detector and electron multiplier converts the impacts into multiplied electrons and emits the multiplied electrons from two or more segmented electrodes on a second side of the multichannel detector and electron multiplier. Each electrode of the two or more segmented electrodes corresponds to and emits electrons based on impacts in a different region across a length of the first side.

A multichannel digitizer is electrically connected to the two or more segmented electrodes. The multichannel digitizer converts the electrons received from each electrode of the two or more segmented electrodes for each ion packet of the ion packets into digital values in a channel of the multichannel digitizer.

The processor receives digital values from at least two or more channels of the multichannel digitizer. The processor calculates qualitative information about the ion packets using digital values of a predetermined subset of one or more channels of the at least two or more channels. The predetermined subset of one or more channels is known to provide the highest resolution of the at least two or more channels. The processor can further calculate quantitative information about the ion packets using digital values of the at least two or more channels.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
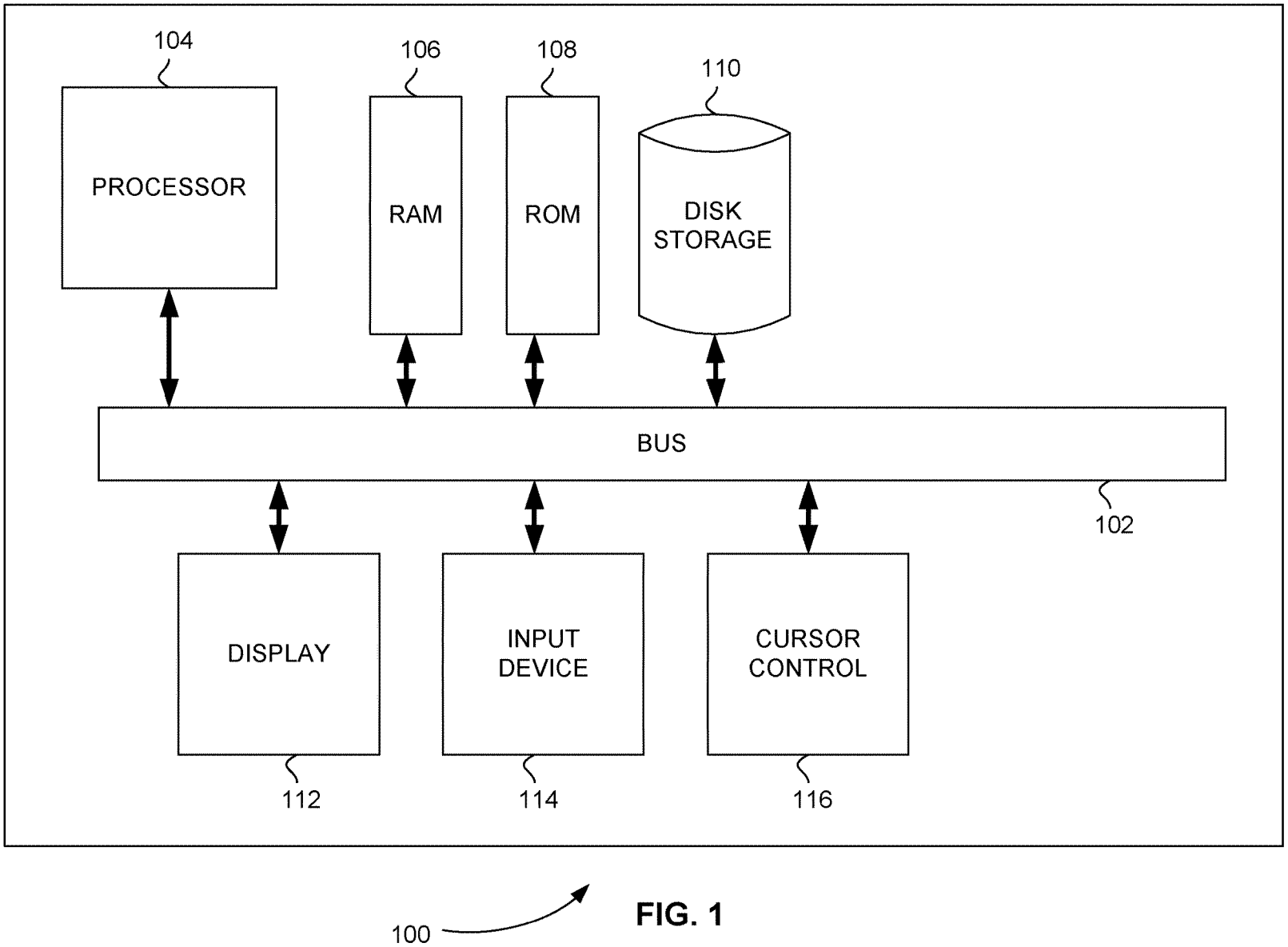
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively, hard-wired circuitry may be used in place of or in combination with software instructions to implement the present teachings Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software, but the present teachings may be implemented as a combination of hardware and software or in hardware alone. The present teachings may be implemented with both object-oriented and non-object-oriented programming systems.

Using Fewer Channels for Qualitative Analysis

As described above, some conventional time-of-flight (TOF) mass analyzers use ion detection systems that include four-channel digitizers. A four-channel digitizer can include either a time-to-digital converter (TDC) or an analog-to-digital converter (ADC), for example. Multichannel ion detection systems provide two main benefits: enhanced dynamic range and improved resolution through independent calibration of channels (also known as channel alignment).

Resolution on a TOF mass analyzer is a key driver of instrument performance. Unfortunately, over time, the resolution of a TOF mass analyzer can degrade until it is no longer acceptable for a customer.

For a multichannel TOF mass analyzer, the resolution of some channels can degrade faster and greater than other channels. For example, in a four-channel TOF mass analyzer, the resolutions measured by the two channels receiving data from the two outermost electrodes typically degrade faster than the resolutions measured by the two channels receiving data from the two innermost electrodes.

Simply discarding data from any channel with a degraded resolution may appear, at first, to be a solution to this problem. However, discarding the signal of even a single channel can reduce the overall sensitivity of the TOF mass analyzer and defeat the original purpose of using a multichannel ion detection system.

As a result, additional systems and methods are needed to address the problem of degraded resolution in some channels of a multichannel ion detection system of a TOF mass analyzer.

One of ordinary skill in the art can appreciate that the terms "mass analyzer" and "mass spectrometer" can be used interchangeably. Generally, a mass analyzer refers to a device at one or more stages of a mass spectrometer. In other words, the mass analyzer is typically just one component of a mass spectrometer. However, it is common in industry practice to refer to an entire mass spectrometer in terms of its mass analyzer. For example, a mass spectrometer that includes a TOF mass analyzer is often referred to as a TOF mass spectrometer even though the TOF mass analyzer is just one component.

Resolution and Channel Alignment

One of the benefits of a multichannel ion detection system is improved resolution through independent calibration of channels, called channel alignment. Channel alignment is needed due to the non-ideal way in which ion packets are shaped when they impact the detector.

Figure 2:
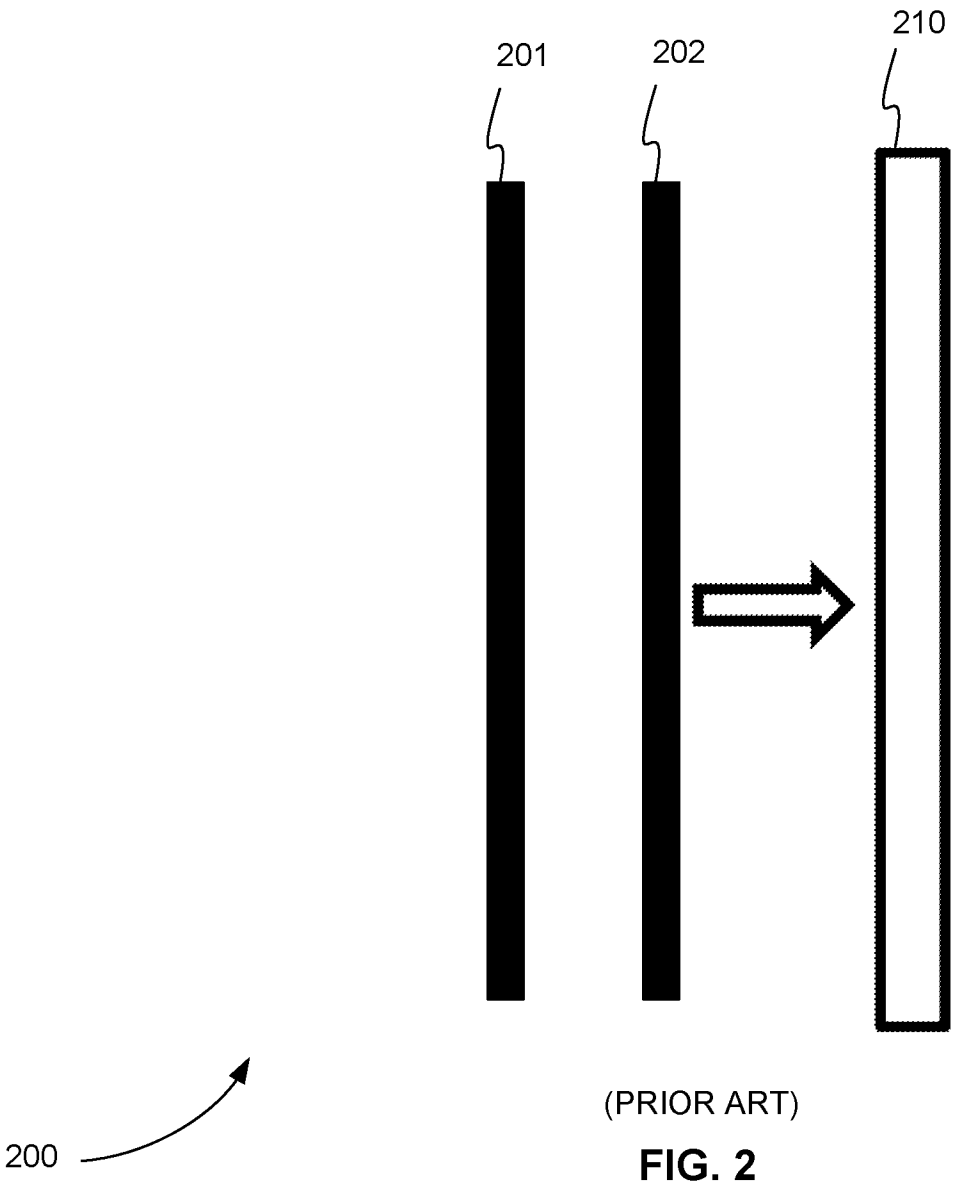
(PRIOR ART) FIG. 2
FIG. 2 is a side view of a time-of-flight (TOF) ion detection system showing exemplary ion packets that each has an ideal shape and an ideal orientation just before they impact a microchannel plate (MCP) of the TOF ion detection system.

FIG. 2 is a side view 200 of a TOF ion detection system showing exemplary ion packets that each has an ideal shape and an ideal orientation just before they impact a microchannel plate (MCP) of the TOF ion detection system. An MCP is a device that converts ion impacts on one side of the MCP to electron emissions on the corresponding other side of the MCP. Typically, an MCP produces many electrons for each ion impact. As a result, an MCP acts as a multiplier or amplifier of ion impacts. Due to this amplification effect, multiple MCPs can also be used in series to increase the amplification of ion impacts.

The shapes of ion packets 201 and 202 are ideal with respect to MCP 210 of FIG. 2 because they are essentially the same flat shape as MCP 210. In other words, due to this shape, all of the ions of ion packet 201 will strike MCP 210 at the same time, and all of the ions of ion packet 202 will also strike MCP 210 at the same time.

The orientations of ion packets 201 and 202 are ideal with respect to MCP 210 because they are essentially parallel to MCP 210. Again, this orientation allows all of the ions of ion packet 201 to strike MCP 210 at the same time and all of the ions of ion packet 202 to strike MCP 210 at the same time.

The shape and orientation of ion packets are important because they affect the resolution of a TOF ion detection system. Again, in a TOF ion detection system, resolution essentially refers to how well the distance between ion packets can be measured. In other words, the highest resolution would be the minimum distance between two ion packets where those two different ion packets could still be resolved.

The ideal shape and ideal orientation of ion packets 201 and 202 in FIG. 2 allows for a very high resolution. Ion packets with this shape and orientation can be resolved even if they are placed much closer than ion packets 201 and 202. Ion packets, however, with non-ideal shapes and non-ideal orientations can degrade resolution by increasing the minimum distance between two ion packets where those two different ion packets can still be resolved.

Figure 3:
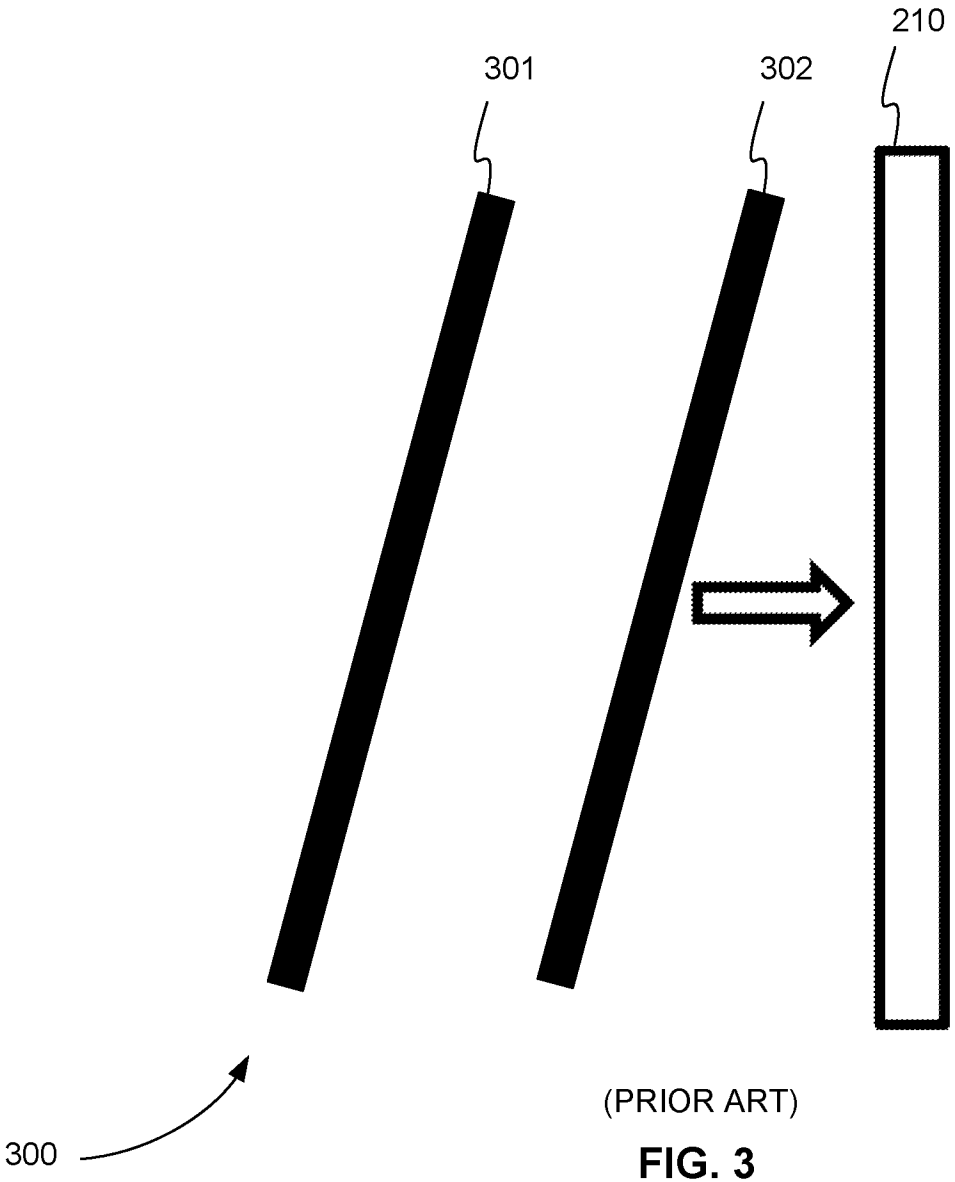
(PRIOR ART) FIG. 3
FIG. 3 is a side view of a TOF ion detection system showing exemplary ion packets that each has an ideal shape and a non-ideal orientation just before they impact an MCP of a TOF ion detection system.

FIG. 3 is a side view 300 of a TOF ion detection system showing exemplary ion packets that each has an ideal shape and a non-ideal orientation just before they impact an MCP of a TOF ion detection system. In FIG. 3, ion packets 301 and 302 are oriented at an angle, or are tilted, with respect to MCP 210. This tilting of ion packets 301 and 302 within the ion beam causes a decrease in resolution.

This decrease in resolution can be seen by determining if ion packets 301 and 302 can be placed closer together and still be distinguished at MCP 210. If ion packet 301 is placed closer to ion packet 302 its leading edge immediately starts to overlap the trailing edge of ion packet 302. If these edges overlap, the ion packets cannot be distinguished at MCP 210. This means that ion packets 301 and 302 cannot be placed much closer together. Therefore, a comparison of FIGS. 2 and 3 show how a non-ideal orientation can degrade resolution.

In practice, it is common for TOF mass analyzers to produce ion packets with tilted or non-ideal orientations. Fortunately, however, there is a conventional remedy to this problem. In order to compensate for the tilted packets, the MCP can be correspondingly tilted in a calibration step to account for ion packets with tilted or non-ideal orientations. Non-ideal ion packet shape can also degrade resolution.

Figure 4:
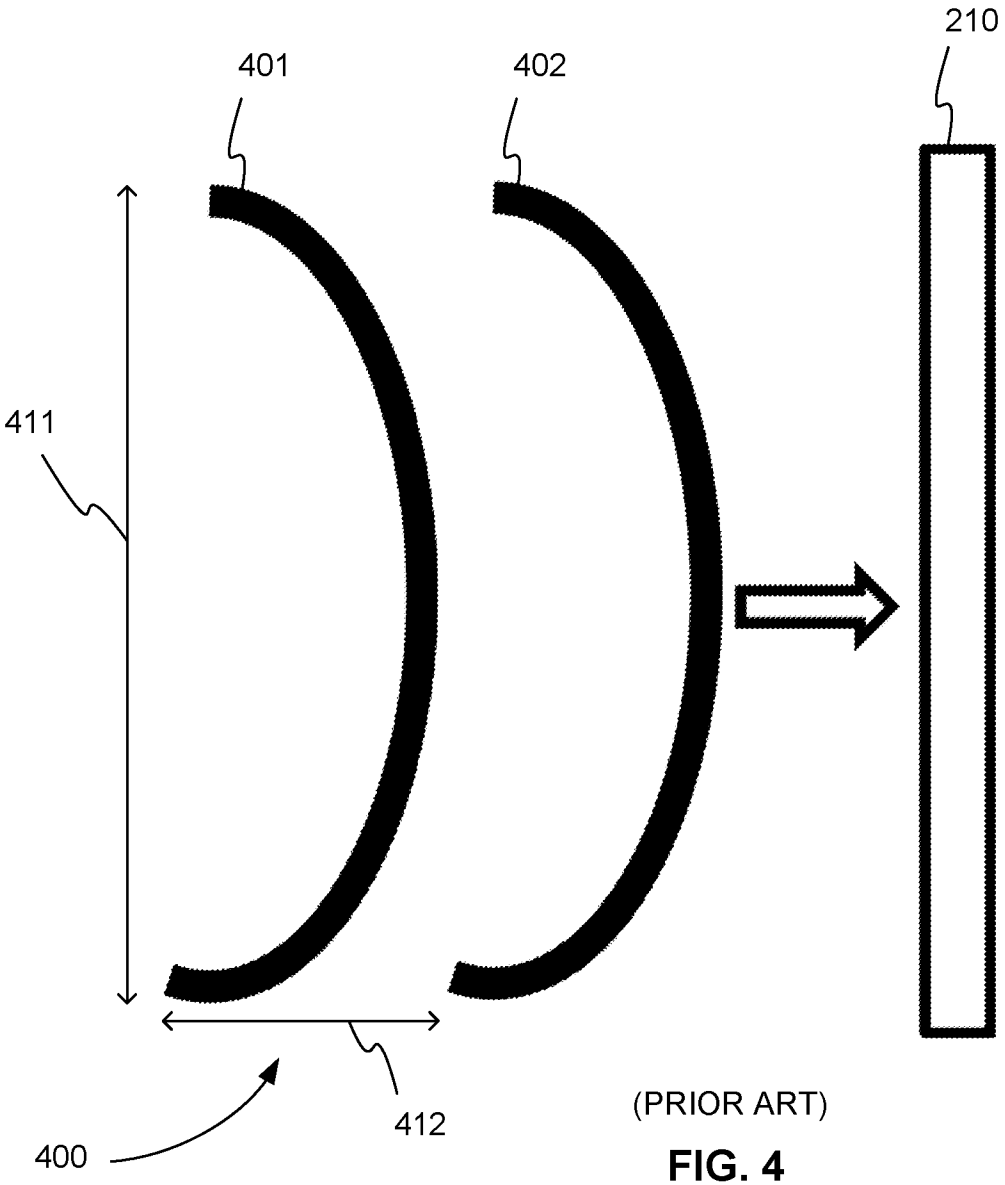
(PRIOR ART) FIG. 4
FIG. 4 is a side view of a TOF ion detection system showing exemplary ion packets that each has a non-ideal shape and an ideal orientation just before they impact an MCP of a TOF ion detection system.

FIG. 4 is a side view 400 of a TOF ion detection system showing exemplary ion packets that each has a non-ideal shape and an ideal orientation just before they impact an MCP of a TOF ion detection system. In FIG. 4, ion packets 401 and 402 have an arched sausage or convex shape with respect to MCP 210. The length 411 of ion packet 401 is about 40 mm, and the depth of convexity 412 of ion packet 401 is much less than 1 mm, for example. The convex shape of ion packets 401 and 402 in TOF mass analyzers is common.

This convex shape reduces the resolution of the ion detection system. Like ion packets 301 and 302 of FIG. 3, ion packets 401 and 402 of FIG. 4 cannot be resolved at MCP 210 if they are much closer than is shown in FIG. 4. This is because, for example, the two trailing edges of ion packet 402 would overlap with the leading edge of ion packet 401 if ion packets 401 and 402 are placed any closer together. Like ion packets, MCPs can also have non-ideal shapes. In practice, MCPs often have a convex shape.

Four-Channel Digitizer

Conventional TOF ion detection systems have compensated for the loss of resolution caused by the convex shape of ion packets and the convex shape of an MCP by using four electrodes and a four-channel digitizer.

Figure 5:
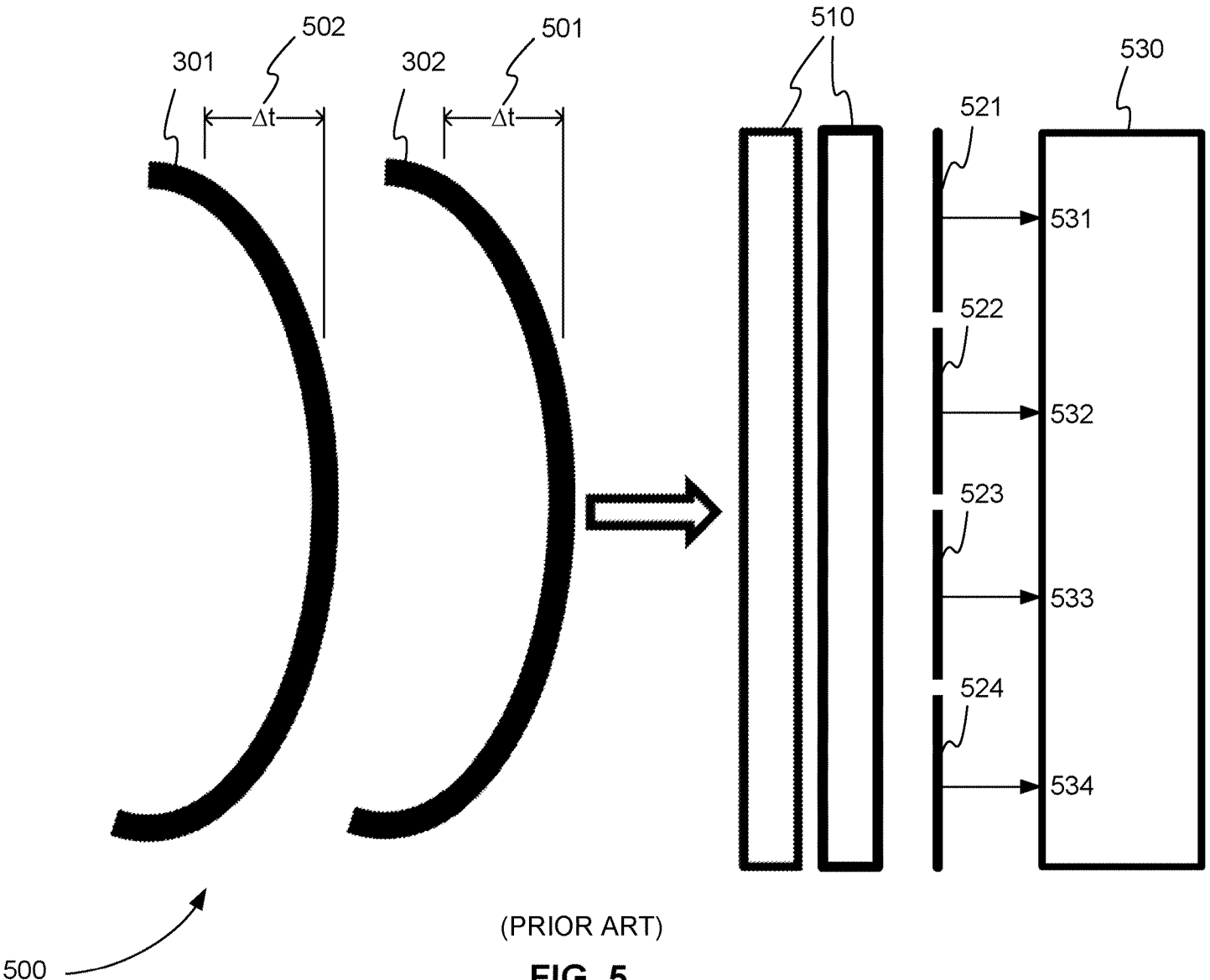
(PRIOR ART) FIG. 5
FIG. 5 is a side view of a TOF ion detection system showing how the digitized signals of exemplary ion packets that each has a non-ideal shape are obtained using four electrodes and a four-channel digitizer to improve resolution.

FIG. 5 is a side view 500 of a TOF ion detection system showing how the digitized signals of exemplary ion packets that each has a non-ideal shape are obtained using four electrodes and a four-channel digitizer to improve resolution. In FIG. 5, two MCPs 510 positioned in series are impacted by ion packets 301 and 302, which have convex shapes. Multiplied electrons produced by MCPs 510 are collected by four segmented anode electrode plates 521, 522, 523, and 524. Each of anode electrode plates 521, 522, 523, and 524 is electrically connected to a separate channel of four-channel digitizer 530.

Four-channel digitizer 530 is, for example, an ADC or a TDC. Each of anode electrode plates 521, 522, 523, and 524 can also be electrically connected to four-channel digitizer 530 through a four-channel preamplifier (not shown), for example. A four-channel preamplifier amplifies the electrical signal received from the electrode plates.

MCPs 510 essentially translate an ion impact image on one side to a corresponding electron emission image on the other side. Although ion packets 301 and 302 have convex shapes, their images on either side of MCPs 510 have a rectangular pattern or shape.

Figure 6:
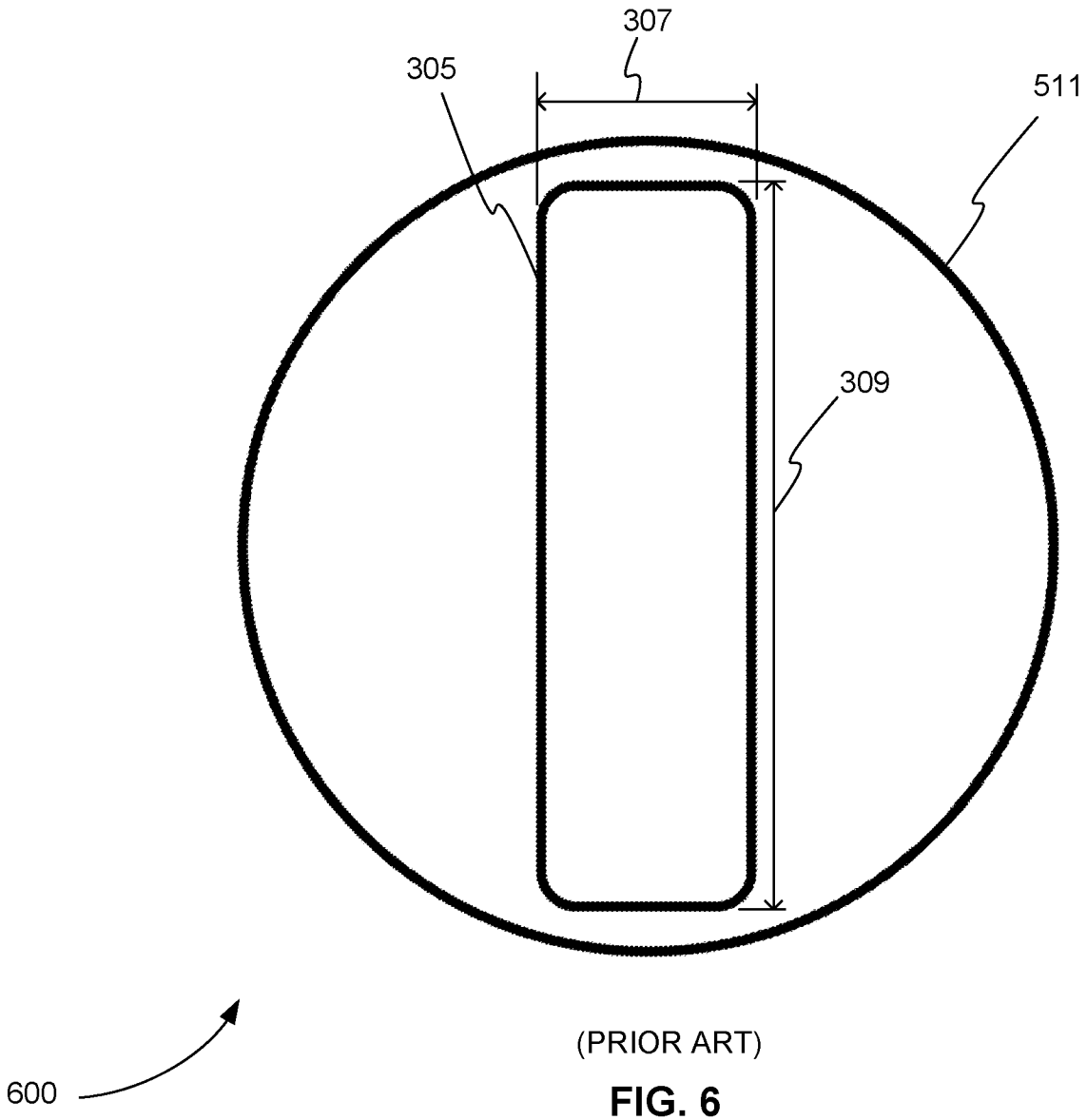
(PRIOR ART) FIG. 6
FIG. 6 is a front view of the impact side of the MCPs of FIG. 5 showing that ion packets impact the MCPs in a rectangular pattern.

FIG. 6 is a front view 600 of the impact side of the MCPs of FIG. 5 showing that ion packets impact the MCPs in a rectangular pattern. In FIG. 6, side 511 of MCPs 510 of FIG. 5 are impacted by ion packets 301 and 302 of FIG. 5 in a rectangular pattern or image 305. Because ion packets 301 and 302 of FIG. 5 have a convex shape, ions of each packet impact the central or inner portion of rectangular pattern 305 of FIG. 6 first. Later in time, ions of each packet impact the outer two edges of rectangular pattern 305. Typically, rectangular pattern 305 has a width 307 of about 10 mm and a length 309 of about 40 mm. Electrons are emitted from the other side of MCPs 510 of FIG. 5 in the same rectangular pattern as rectangular pattern 305.

Figure 7:
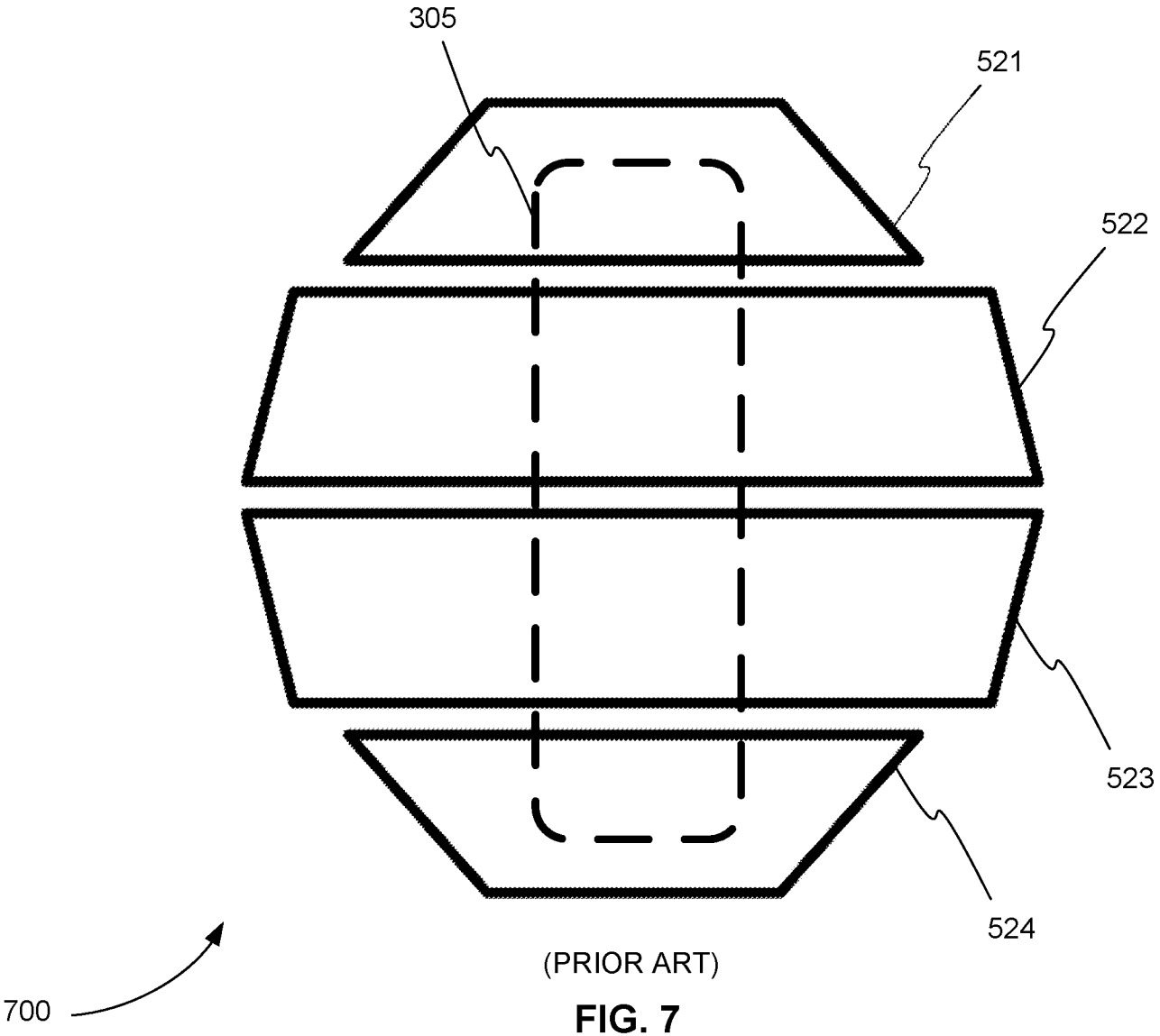
(PRIOR ART) FIG. 7
FIG. 7 is a front view of the four electrodes of FIG. 5.

FIG. 7 is a front view 700 of the four electrodes of FIG. 5. FIG. 7 shows how four segmented anode electrode plates 521, 522, 523, and 524 are positioned to detect ions from a circular MCP, for example. Electrons are emitted onto electrodes 521, 522, 523, and 524 using an MCP producing corresponding rectangular pattern 305 of electrons.

Each of anode electrode plates 521, 522, 523, and 524 is able to detect a different part of the rectangular pattern 305 over time. Note that the rectangular pattern is most convex along the length of the rectangular pattern because the rectangular pattern is much longer than it is wide. By detecting different parts of rectangular pattern 305 over time, the convex shape of each ion packet is detected.

Returning to FIG. 5, the four channels 531, 532, 533, and 534 of four-channel digitizer 530 are calibrated to combine or align the measurements from the different channels at different times to account for the lengthwise convexity of the ion packets.

Figure 8:
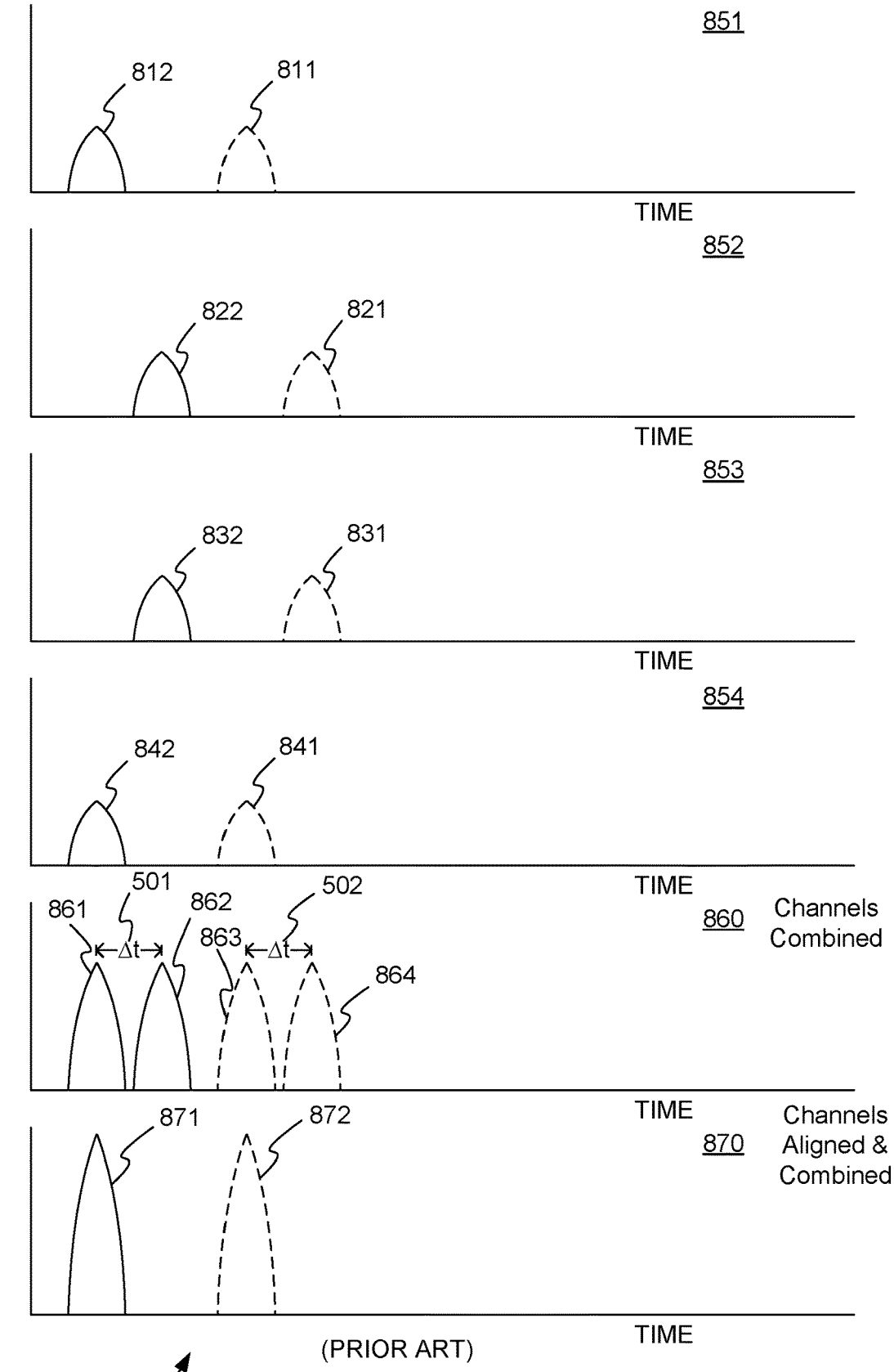
(PRIOR ART) FIG. 8
FIG. 8 is an exemplary series of timing diagrams showing how the measurements from the four channels of the four-channel digitizer in FIG. 5 are aligned or combined to compensate for the non-ideal shape of ion packets and improve the overall resolution of an ion detection system.

FIG. 8 is an exemplary series of timing diagrams 800 showing how the measurements from the four channels of the four-channel digitizer in FIG. 5 are aligned or combined to compensate for the non-ideal shape of ion packets and improve the overall resolution of an ion detection system. Each of the timing diagrams is a plot of the intensity of the electron flux as a function of time.

In FIG. 8, timing diagram 851 shows intensities 812 and 811 for ion packets 302 and 301, respectively, of FIG. 5 measured in channel 531 of four-channel digitizer 530 of FIG. 5. Timing diagram 852 of FIG. 8 shows intensities 822 and 821 for ion packets 302 and 301, respectively, of FIG. 5 measured in channel 532 of four-channel digitizer 530 of FIG. 5. Timing diagram 853 of FIG. 8 shows intensities 832 and 831 for ion packets 302 and 301, respectively, of FIG. 5 measured in channel 533 of four-channel digitizer 530 of FIG. 5. Finally, timing diagram 854 of FIG. 8 shows intensities 842 and 841 for ion packets 302 and 301, respectively, of FIG. 5 measured in channel 534 of four-channel digitizer 530 of FIG. 5.

In timing diagram 860 of FIG. 8, the intensities measured in timing diagrams 851, 852, 853, and 854 are combined. For example, these values are summed in timing diagram 860. This results in two intensity peaks for each of ion packets 302 and 301 of FIG. 5, one that is a combination of measurements from the two inner electrode plates 522 and 523 of FIG. 5 and one that is a combination of measurements from the two outer electrode plates 521 and 524 of FIG. 5. For example, in timing diagram 860 of FIG. 8, peaks 861 and 862 are the two intensity peaks measured from ion packet 302 of FIG. 5 and peaks 863 and 864 are the two intensity peaks measured from ion packet 301 of FIG. 5.

Note that in FIG. 5, due to the convex shape of the ion packets, the time difference between the detection of the central or inner ions of an ion packet at electrodes 522 and 523 and the detection of the outer ions of an ion packet at electrodes 521 and 524 is $\Delta t$ 501. In FIG. 8, this $\Delta t$ 501 is the difference between the centers of peaks 861 and 862 and Δt 502 is the difference between the centers of peaks 863 and 864. This time difference Δt 501 or Δt 502 produced by the convex shapes of the ion packets decreases the detection resolution. It decreases the detection resolution by decreasing the space between the intensities that can be measured for two different packets. In other words, as shown in timing diagram 860, because the intensities of the single ion packet are spread out over time due to the convex shape of the ion packet, the resolution is reduced.

However, because multiple channels are used to measure different parts of the convex shape of an ion packet, it is possible to compensate for the spreading out of intensities. This is shown in timing diagram 870. Essentially, peaks 861 and 862 for ion packet 302 of FIG. 5 are combined into peak 871, and peaks 863 and 864 for ion packet 302 of FIG. 5 are combined into peak 872 in timing diagram 870 of FIG. 8. In other words, digitizer 530 of FIG. 5 is calibrated to align the intensities of channels 531 and 534 with the intensities of channels 532 and 533. This calibration is done, for example, using the calibration equation $m=a\times(t-t_0)^2$, where m is mass, a is slope, t is time, and to is the time offset. Once calibrated, the intensities of all four channels are combined.

Timing diagram 870 of FIG. 8 shows that the resolution has been restored. In other words, the spacing between the peaks (871 and 872) of different packets has been increased. This can be shown more clearly if the ion packets of FIG. 5 are overlapping.

Figure 9:
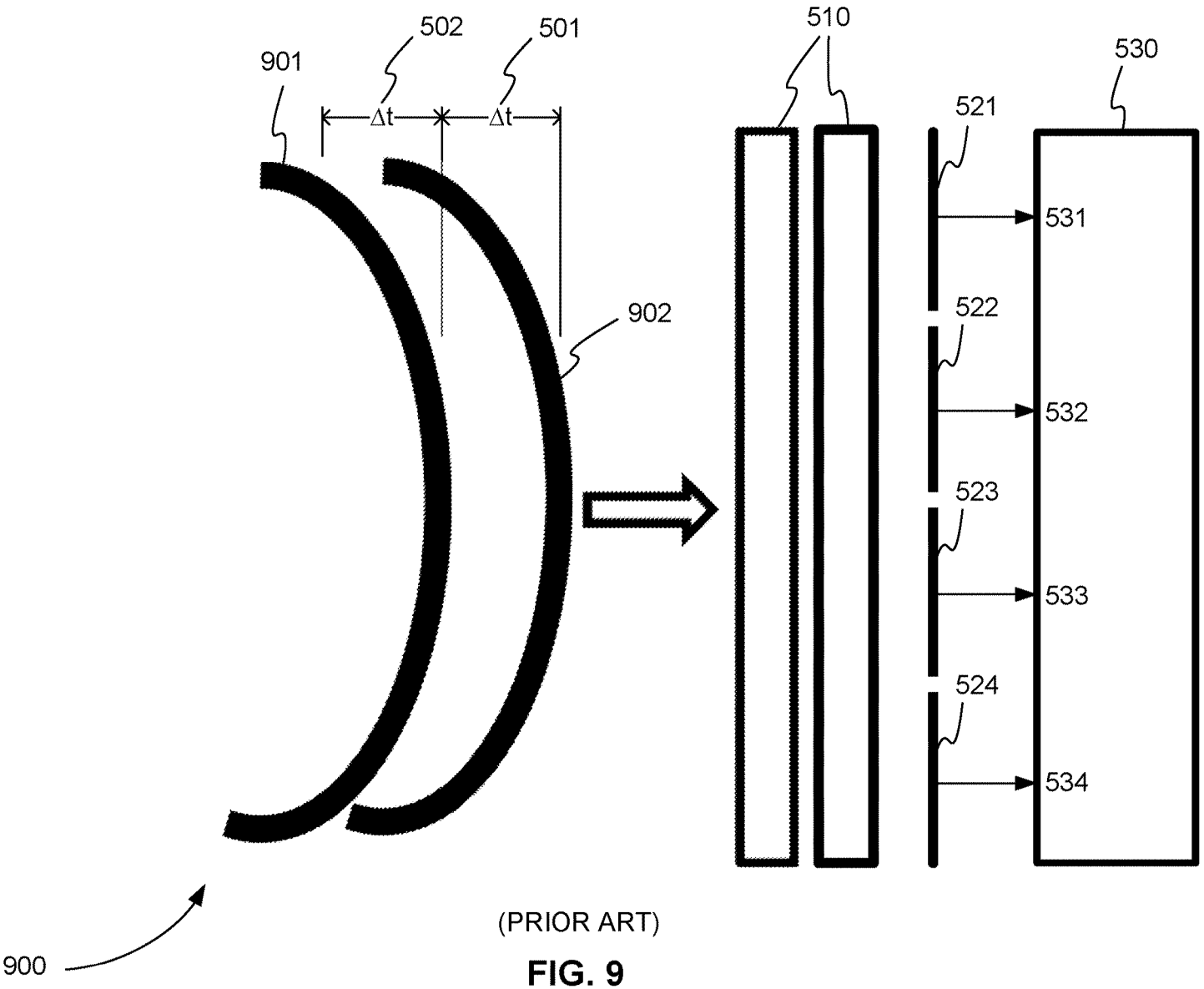
(PRIOR ART) FIG. 9
FIG. 9 is a side view of the same TOF ion detection system as shown in FIG. 5 with exemplary ion packets that overlap.

FIG. 9 is a side view 900 of the same TOF ion detection system as shown in FIG. 5 with exemplary ion packets that overlap. In FIG. 9, the leading of ion packet 901 overlaps with the trailing edge of ion packet 902. If only one electrode and one digitizing channel were used, ion packets 901 and 902 could not be distinguished. However, by using separated electrodes and a four-channel digitizer, packets 901 and 902 can be distinguished.

Figure 10:
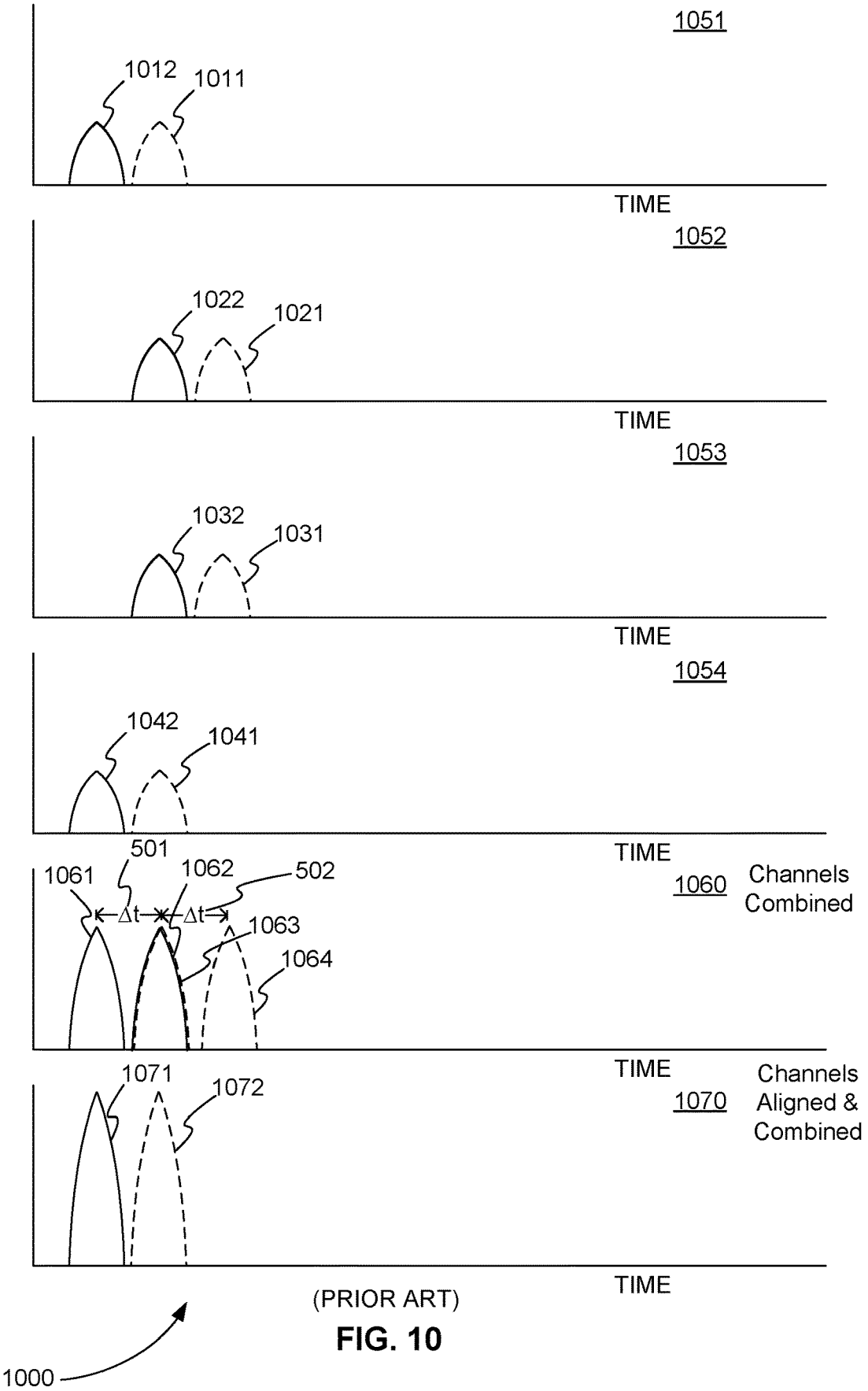
(PRIOR ART) FIG. 10
FIG. 10 is an exemplary series of timing diagrams showing how the measurements from the four channels of the four-channel digitizer in FIG. 9 are aligned or combined to compensate for the non-ideal shape of ion packets and improve the overall resolution of an ion detection system even when ion packets overlap.

FIG. 10 is an exemplary series of timing diagrams 1000 showing how the measurements from the four channels of the four-channel digitizer in FIG. 9 are aligned or combined to compensate for the non-ideal shape of ion packets and improve the overall resolution of an ion detection system even when ion packets overlap. In FIG. 10, timing diagram 1051 shows intensities 1012 and 1011 for ion packets 902 and 901, respectively, of FIG. 9 measured in channel 531 of four-channel digitizer 530 of FIG. 9. Timing diagram 1052 of FIG. 10 shows intensities 1022 and 1021 for ion packets 902 and 901, respectively, of FIG. 9 measured in channel 532 of four-channel digitizer 530 of FIG. 9. Timing diagram 1053 of FIG. 10 shows intensities 1032 and 1031 for ion packets 902 and 901, respectively, of FIG. 9 measured in channel 533 of four-channel digitizer 530 of FIG. 9. Finally, timing diagram 1054 of FIG. 10 shows intensities 1042 and 1041 for ion packets 902 and 901, respectively, of FIG. 9 measured in channel 534 of four-channel digitizer 530 of FIG. 9.

In timing diagram 1060 of FIG. 10, the intensities measured in timing diagrams 1051, 1052, 1053, and 1054 are combined. This results in two intensity peaks for each of ion packets 902 and 901 of FIG. 9, one that is a combination of measurements from the two inner electrode plates 522 and 523 of FIG. 9 and one that is a combination of measurements from the two outer electrode plates 521 and 524 of FIG. 9. For example, in timing diagram 1060 of FIG. 10, peaks 1061 and 1062 are the two intensity peaks measured from ion packet 902 of FIG. 9 and peaks 1063 and 1064 are the two intensity peaks measured from ion packet 901 of FIG. 9.

Note in FIG. 10 that peak 1062 of ion packet 902 of FIG. 9 overlaps with peak 1063 of ion packet 901 of FIG. 9. This shows that the overlap caused by the convex shapes of the ion packets in FIG. 9 reduces the resolution.

However, because multiple channels are used to measure different parts of the convex shape of an ion packet, it is possible to compensate for this overlap. This is shown in timing diagram 1070. Essentially, peaks 1061 and 1062 for ion packet 902 of FIG. 9 are combined into peak 1071, and peaks 1063 and 1064 for ion packet 902 of FIG. 9 are combined into peak 1072 in timing diagram 1070 of FIG. 10. This is done, for example, by recalibrating channels 531 and 534 to match peak position on channels 532 and 533. Once recalibrated, the intensities of all four channels are combined, and the overlap is eliminated.

Poor Resolution of Some Channels Degrades Overall Resolution

As described above, for a multichannel TOF mass analyzer, the resolution of some channels can degrade faster and greater than other channels. For example, in a four-channel TOF mass analyzer, the resolutions measured by the two channels receiving data from the two outermost electrodes typically degrade faster than the resolutions measured by the two channels receiving data from the two innermost electrodes. Returning to FIG. 7, for example, the resolutions measured by the two channels receiving data from the two outermost electrodes 521 and 524 typically degrade faster than the resolutions measured by the two channels receiving data from the two innermost electrodes 522 and 523.

Figure 11:
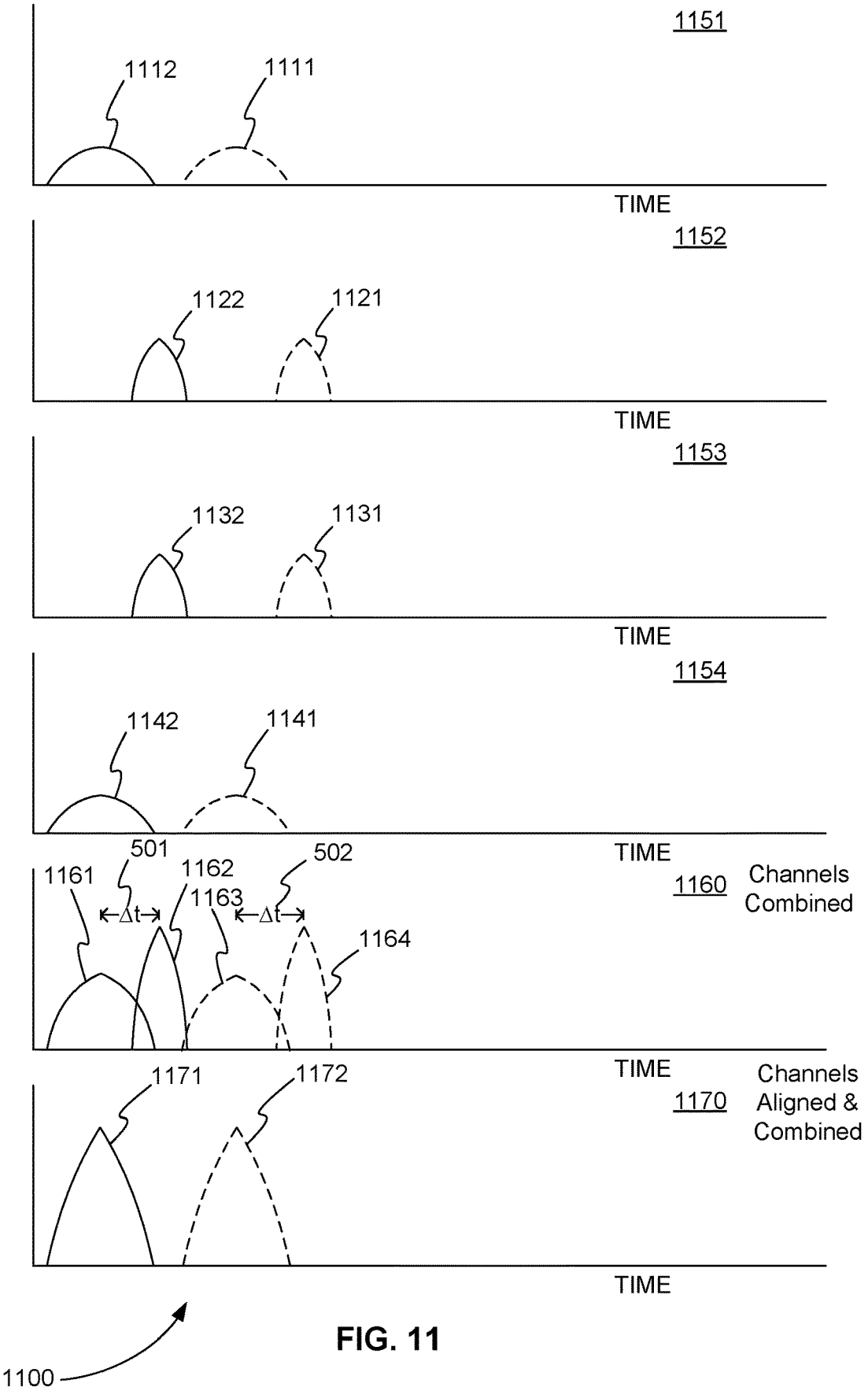
FIG. 11 is an exemplary series of timing diagrams showing how the measurements from the four channels of the four-channel digitizer in FIG. 5 can vary in resolution, in accordance with various embodiments.

FIG. 11 is an exemplary series of timing diagrams 1100 showing how the measurements from the four channels of the four-channel digitizer in FIG. 5 can vary in resolution, in accordance with various embodiments. In FIG. 11, timing diagram 1151 shows intensities 1112 and 1111 for ion packets 302 and 301, respectively, of FIG. 5 measured in channel 531 of four-channel digitizer 530 of FIG. 5. Timing diagram 1152 of FIG. 11 shows intensities 1122 and 1121 for ion packets 302 and 301, respectively, of FIG. 5 measured in channel 532 of four-channel digitizer 530 of FIG. 5. Timing diagram 1153 of FIG. 11 shows intensities 1132 and 1131 for ion packets 302 and 301, respectively, of FIG. 5 measured in channel 533 of four-channel digitizer 530 of FIG. 5. Finally, timing diagram 1154 of FIG. 11 shows intensities 1142 and 1141 for ion packets 302 and 301, respectively, of FIG. 5 measured in channel 534 of four-channel digitizer 530 of FIG. 5.

In FIG. 11, timing diagrams 1151 and 1154 show intensities with degraded resolutions as compared to timing diagrams 1152 and 1153. These degraded resolutions reflect the degraded resolutions typically found for the two outermost electrodes 521 and 524 of FIG. 5.

Again, in timing diagram 1160 of FIG. 11, the intensities measured in timing diagrams 1151, 1152, 1153, and 1154 are combined. For example, these values are summed in diagram 1160. This results in two intensity peaks for each of ion packets 302 and 301 of FIG. 5, one that is a combination of measurements from the two inner electrode plates 522 and 523 of FIG. 5 and one that is a combination of measurements from the two outer electrode plates 521 and 524 of FIG. 5. For example, in timing diagram 1160 of FIG. 11, peaks 1161 and 1162 are the two intensity peaks measured from ion packet 302 of FIG. 5 and peaks 1163 and 1164 are the two intensity peaks measured from ion packet 301 of FIG. 5.

Note that in FIG. 5, due to the convex shape of the ion packets, the time difference between the detection of the central or inner ions of an ion packet at electrodes 522 and 523 and the detection of the outer ions of an ion packet at electrodes 521 and 524 is Δt 501. In FIG. 11, this Δt 501 is the difference between the centers of peaks 1161 and 1162 and Δt 502 is the difference between the centers of peaks 1163 and 1164. This time difference Δt 501 or Δt 502 produced by the convex shapes of the ion packets decreases the detection resolution. It decreases the detection resolution by decreasing the space between the intensities that can be measured for two different packets. In other words, as shown in timing diagram 1160, because the intensities of the single ion packet are spread out over time due to the convex shape of the ion packet, the resolution is reduced.

However, because multiple channels are used to measure different parts of the convex shape of an ion packet, it is possible to compensate for the spreading out of intensities. This is shown in timing diagram 1170. Essentially, peaks 1161 and 1162 for ion packet 302 of FIG. 5 are combined into peak 1171, and peaks 1163 and 1164 for ion packet 302 of FIG. 5 are combined into peak 1172 in timing diagram 1170 of FIG. 11. In other words, digitizer 530 of FIG. 5 is calibrated to align the intensities of channels 531 and 534 with the intensities of channels 532 and 533. This calibration is done, for example, using the calibration equation $m=a\times(t-t_0)^2$, where m is mass, a is slope, t is time, and $t_0$ is the time offset. Once calibrated, the intensities of all four channels are combined.

Timing diagram 1170 of FIG. 11 shows that some resolution has been restored. In other words, the spacing between the peaks (1171 and 1172) of different packets has been increased. However, in comparison to the resolutions found in timing diagrams 1152 and 1154, the resolution remains degraded. In other words, FIG. 11 shows that the decreased resolution found in two channels reduces the overall resolution of the TOF mass analyzer even after intensities are aligned and combined.

Use only Highest Resolution Channels for Qualitative Analysis

In various embodiments, the problem of degraded resolution in some channels of a multichannel ion detection system of a TOF mass analyzer degrading the overall resolution is solved by separately using the signal intensity detected in the highest resolution channels for qualitative analysis and using the signal intensity of the highest resolution channels and lower resolution channels for quantitative analysis. Returning to FIG. 5, for example, the digital values of channels 532 and 533 of digitizer 530 are used to get the signal intensity and resolution for qualitative analysis. However, for quantitative analysis (intensity only), the digital values of channels 531 and 534 of digitizer 530 are used in addition to the digital values of channels 532 and 533.

In various embodiments, for quantitative analysis, at each bin (m/z), one approach is to only include the intensity from channels 531 and 534, if there is also signal in channels 532 and 533 at this same bin (m/z). This approach ignores a small part the signal that comes from the wider, poorly resolved portions of channels 531 and 534, but still captures most of the signal and keeps the resolution from the channels 532 and 533.

Figure 12:
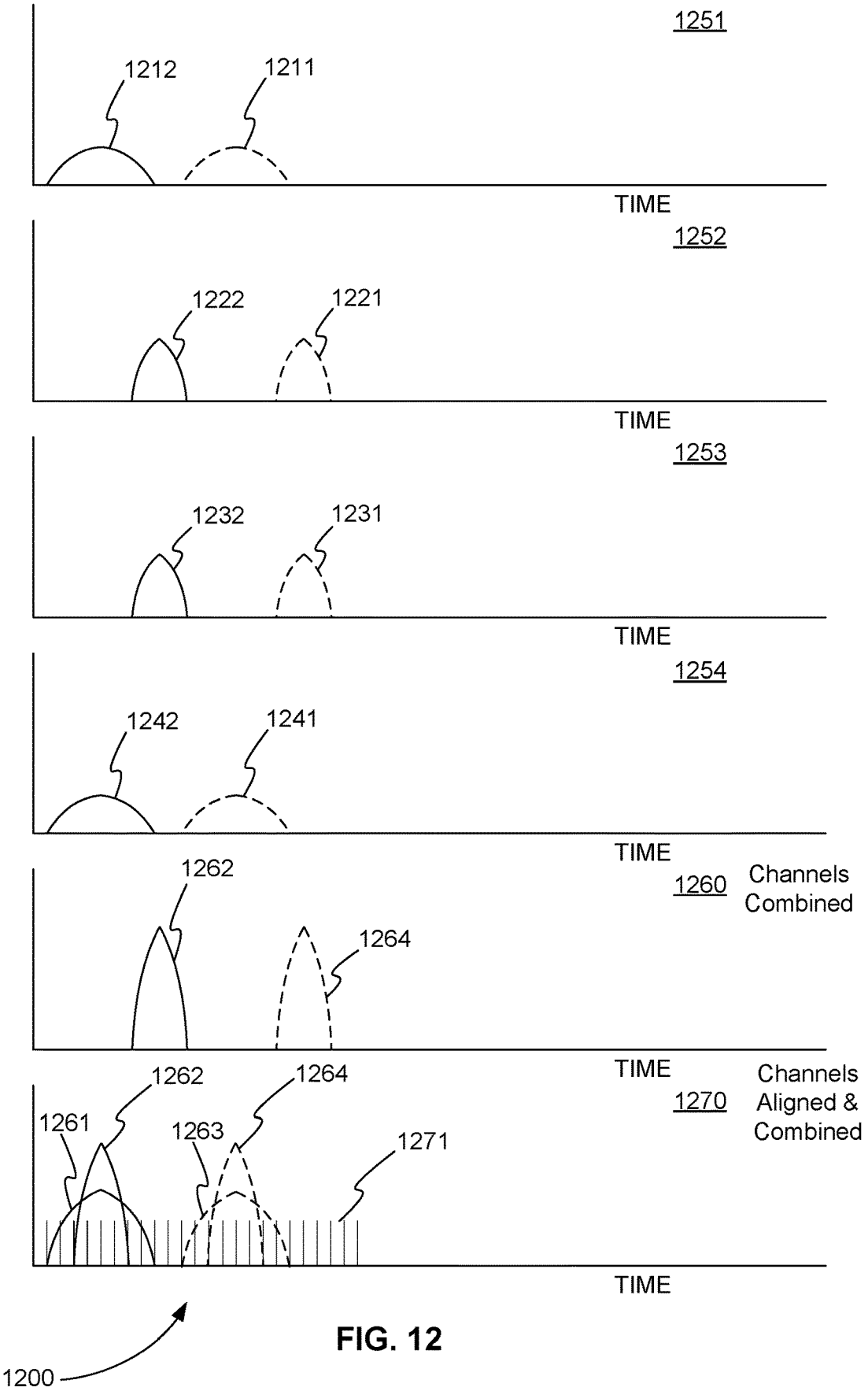
FIG. 12 is an exemplary series of timing diagrams showing how the measurements from the four channels of the four-channel digitizer in FIG. 5 can be combined separately for qualitative and quantitative analysis when the measurements from the four channels varying in resolution, in accordance with various embodiments.

FIG. 12 is an exemplary series of timing diagrams 1200 showing how the measurements from the four channels of the four-channel digitizer in FIG. 5 can be combined separately for qualitative and quantitative analysis when the measurements from the four channels vary in resolution, in accordance with various embodiments. Again, in FIG. 12, timing diagram 1251 shows intensities 1212 and 1211 for ion packets 302 and 301, respectively, of FIG. 5 measured in channel 531 of four-channel digitizer 530 of FIG. 5. Timing diagram 1252 of FIG. 12 shows intensities 1222 and 1221 for ion packets 302 and 301, respectively, of FIG. 5 measured in channel 532 of four-channel digitizer 530 of FIG. 5. Timing diagram 1253 of FIG. 12 shows intensities 1232 and 1231 for ion packets 302 and 301, respectively, of FIG. 5 measured in channel 533 of four-channel digitizer 530 of FIG. 5. Finally, timing diagram 1254 of FIG. 12 shows intensities 1242 and 1241 for ion packets 302 and 301, respectively, of FIG. 5 measured in channel 534 of four-channel digitizer 530 of FIG. 5.

Again, in FIG. 12, timing diagrams 1251 and 1254 show intensities with degraded resolutions as compared to timing diagrams 1252 and 1253. These degraded resolutions reflect the degraded resolutions typically found for the two outermost electrodes 521 and 524 of FIG. 5.

For qualitative analysis, therefore, only the intensities 1222 and 1221 of timing diagram 1252 and intensities 1232 and 1231 of timing diagram 1253 are combined in timing diagram 1260, producing intensities 1262 and 1264. Timing diagram 1260 shows that the higher resolutions of timing diagrams 1252 and 1253 are preserved using this combination.

For quantitative analysis, intensities 1212 and 1211 of timing diagram 1251 and of intensities 1241 and 1242 of timing diagram 1254 are combined into intensities 1261 and 1263 of timing diagram 1270. However, only portions of intensities 1261 and 1263 are used for quantitative analysis. For example, intensities 1262 and 1264 are aligned with intensities 1261 and 1263. Only those portions of intensities 1261 and 1263 that overlap in time bins or m/z bins with intensities 1262 and 1264 are used for quantitative analysis.

One of skill in the art understands that bins are ranges of time or m/z value that are used to combine intensities. Timing diagram 1270 depicts bins 1271. Bins 1271 show that intensity 1261 overlaps with intensity 1262 in four bins and intensity 1263 overlaps with intensity 1264 in four bins. The intensities for four bins of intensity 1261 and the intensities for the four bins of intensity 1263 are then combined with the intensities 1262 and 1264 for quantitative analysis.

In various embodiments, peak finding is performed for each channel Channels 532 and 533 of FIG. 5 are used to build the best resolution peak shape model. However, the summed intensity of the signal from all channels is used for each peak. This requires more processing power but captures all of the measured signals.

In an alternative embodiment, for example, only one channel with the highest resolution is used for qualitative analysis and the other 3 channels are only used additionally for intensity only quantitative analysis. For example, the digital values of channel 532 are used to get the signal intensity and resolution for qualitative analysis. However, for quantitative analysis (intensity only), the digital values of channels 531, 533, and 534 of digitizer 530 are used in addition to the digital values of channel 532.

Multichannel Ion Detection System

Figure 13:
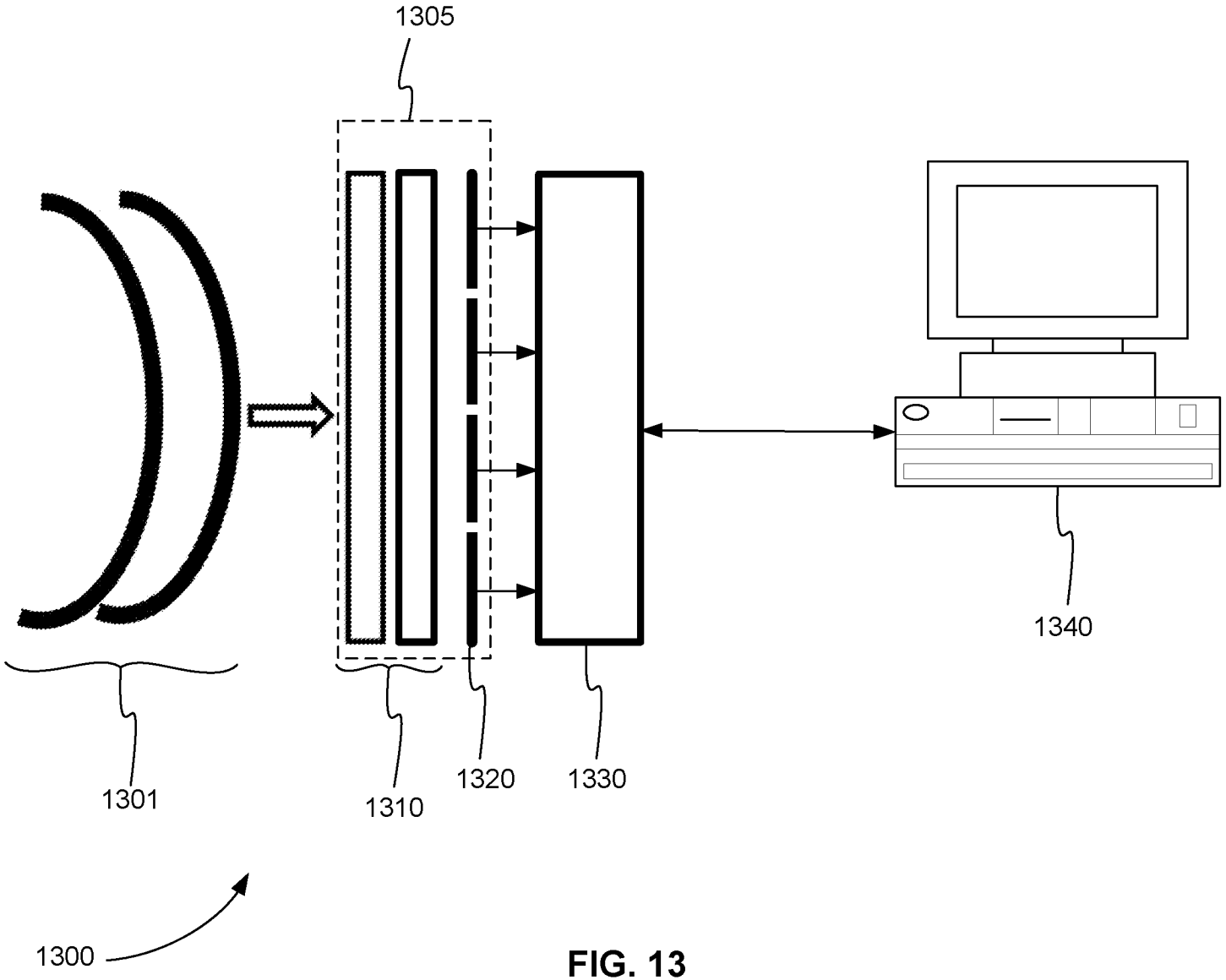
FIG. 13 is an exemplary diagram of a multichannel ion detection system for a TOF mass analyzer that maintains a resolution of the TOF mass analyzer despite a loss of resolution in one or more channels, in accordance with various embodiments.

FIG. 13 is an exemplary diagram 1300 of a multichannel ion detection system for a TOF mass analyzer that maintains a resolution of the TOF mass analyzer despite a loss of resolution in one or more channels, in accordance with various embodiments. The system of FIG. 13 includes multichannel detector and electron multiplier 1305, multichannel digitizer 1330, and processor 1340.

Multichannel detector and electron multiplier 1305 is impacted by ion packets 1301 of a TOF mass analyzer (not shown). Ion packets 1301 impact a first side of multichannel detector and electron multiplier 1305. Multichannel detector and electron multiplier 1305 converts the impacts into multiplied electrons and emits the multiplied electrons from two or more segmented electrodes 1320 on a second side of multichannel detector and electron multiplier 1305. Each electrode of two or more segmented electrodes 1320 corresponds to and emits electrons based on impacts in a different region across a length of the first side.

Multichannel digitizer 1330 can be, but is not limited to, a multichannel ADC or a multichannel TDC. Multichannel digitizer 1330 is electrically connected to two or more segmented electrodes 1320. Multichannel digitizer 1330 converts the electrons received from each electrode of two or more segmented electrodes 1320 for each ion packet of ion packets 1301 into digital values in a channel of multichannel digitizer 1330. Multichannel digitizer 1330 is, for example, a four-channel device as shown in FIG. 13.

Processor 1340 can be a separate device as shown in FIG. 13 or can be a processor or controller used by the mass spectrometer. Processor 1340 can be, but is not limited to, a controller, a computer, a microprocessor, the computer system of FIG. 1, or any device capable of sending and receiving control signals and data and capable of analyzing data.

Processor 1340 receives digital values from at least two or more channels of multichannel digitizer 1330. Processor 1340 calculates qualitative information about the ion packets using digital values of a predetermined subset of one or more channels of the at least two or more channels. The predetermined subset of one or more channels is known to provide the highest resolution of the at least two or more channels. Qualitative information includes, but is not limited to, m/z peak shape.

For example, the at least two or more channels of FIG. 5 are channels 531, 532, 533, and 534. The predetermined subset of one or more channels includes innermost channels 532 and 533, which provide the highest resolution of channels 531, 532, 533, and 534. Or, for example, the at least two or more channels of FIG. 5 are channels 531, 532, and 533. The predetermined subset of one or more channels still includes innermost channels 532 and 533, which provide the highest resolution of channels 531, 532, and 533. In this second case, channel 534 is unused, for example.

Returning to FIG. 13, in various embodiments, processor 1340 further calculates quantitative information about the ion packets using digital values of the at least two or more channels. Quantitative information includes, but is not limited to, m/z peak intensity or area.

In various embodiments, multichannel detector and electron multiplier 1305 can be an electrical system or a photo-electrical system, for example. As shown in FIG. 13, multichannel detector and electron multiplier 1305 is an electrical system that includes one or more microchannel plates 1310 and plurality of segmented anode electrode plates 1320

Series of one or more microchannel plates 1310 is impacted by ion packets 1301 of a TOF mass analyzer (not shown). Ion packets 1301 impact series of one or more microchannel plates 1310 on a first side of series of one or more microchannel plates 1310. Series of one or more microchannel plates 1310 converts the impacts into multiplied electrons emitted from a second side of series of one or more microchannel plates 1310.

Plurality of segmented anode electrode plates 1320 receive the emitted electrons from series of one or more microchannel plates 1310. Plurality of segmented anode electrode plates 1320 is arranged in a plane parallel with series of one or more microchannel plates 1310 and positioned next to series of one or more microchannel plates 1310.

Multichannel detector and electron multiplier 1305 can also be a photo-electrical system, for example.

Figure 14:
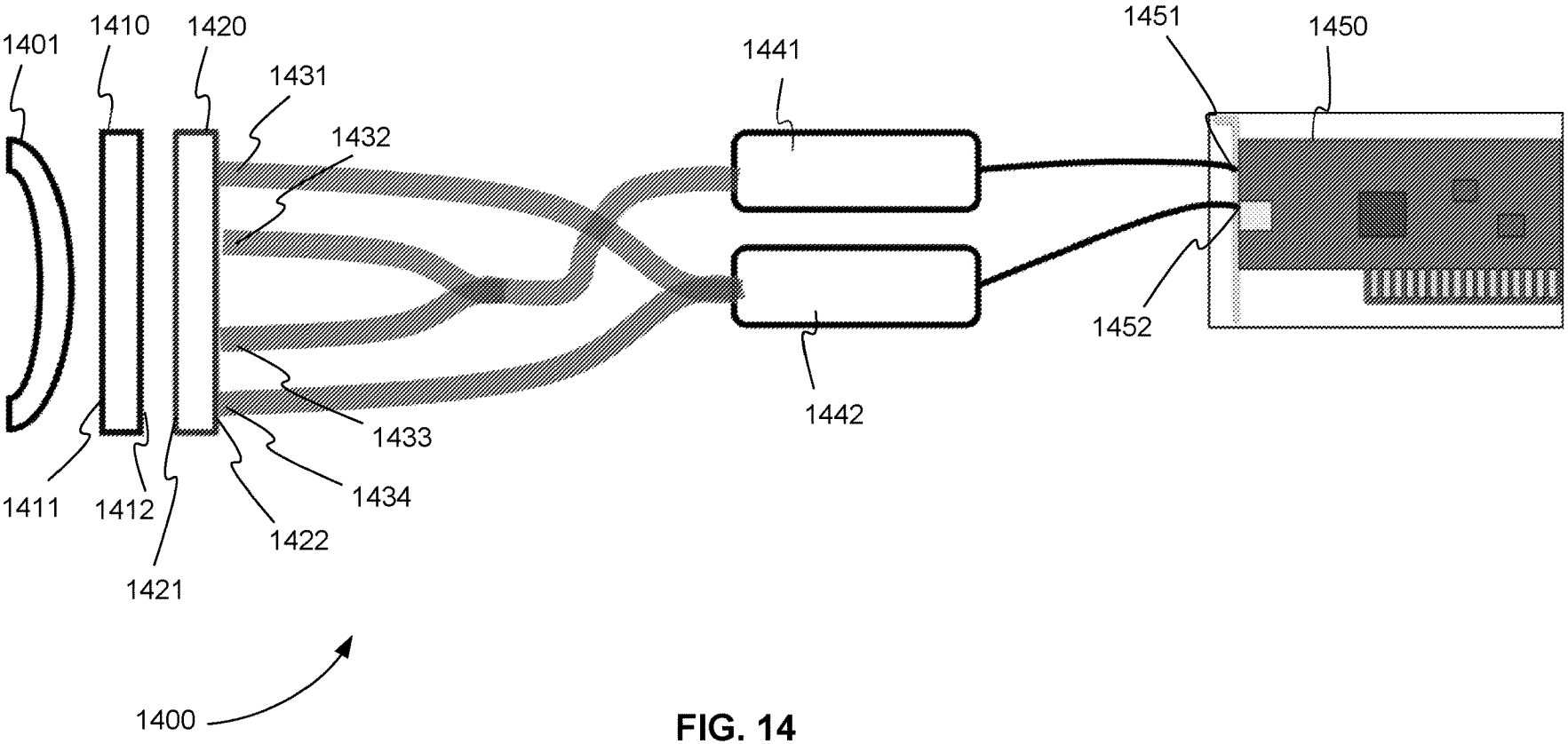
FIG. 14 is a side view of a photo-electrical two-channel ion detection system for a TOF mass analyzer, in accordance with various embodiments.

FIG. 14 is a side view 1400 of a photo-electrical two-channel ion detection system for a TOF mass analyzer, in accordance with various embodiments. The photo-electrical two-channel ion detection system includes series of one or more microchannel plates 1410, scintillator 1420, two or more segmented light pipes 1431, 1432, 1433 and 1434, first photo-multiplier tube (PMT) 1441, second PMT 1442, and two-channel digitizer 1450.

In various embodiments, two-channel digitizer 1450 is a two-channel analog-to-digital converter (ADC). In various embodiments, two-channel digitizer 1450 is a two-channel time-to-digital converter (TDC).

The first one of series of one or more microchannel plates 1410 is impacted by ion packets 1401 in a rectangular pattern on a first side 1411 of series of one or more microchannel plates 1410. Series of one or more microchannel plates 1410 converts the impacts into multiplied electrons emitted in the rectangular pattern on a second side 1412 of series of one or more microchannel plates 1410. A longer side of the rectangular pattern is the length and a shorter side of the rectangular pattern is the width. Due to the convex shape of ion packet 1401, for example, ions of each packet impact a central inner area of the rectangular pattern before impacting two outer areas at each end of the rectangular pattern.

Scintillator 1420 is positioned in parallel with series of one or more microchannel plates 1410 and next to series of one or more microchannel plates 1410. Scintillator 1420 receives the emitted electrons in the rectangular pattern on a first side 1421 of scintillator 1420 from second side 1412 of series of one or more microchannel plates 1410. Scintillator 1420 converts the electrons into photons emitted in the rectangular pattern on a second side 1422 of scintillator 1420.

Two or more segmented light pipes 1431, 1432, 1433, and 1434 are connected to second side 1422 of scintillator 1420 to receive the photons from second side 1422 of scintillator 1420. Two or more segmented light pipes 1431, 1432, 1433, and 1434 together have an area large enough to receive photons from the rectangular pattern. Two or more light pipes 1431, 1432, 1433, and 1434 include one or more inner light pipes 1432 and 1433 positioned to receive photons from the central inner area of the rectangular pattern. Two or more light pipes 1431, 1432, 1433, and 1434 include one or more outer light pipes 1431 and 1434 positioned to receive photons from the two outer areas at each end of the rectangular pattern.

First photo-multiplier tube 1441 is connected to one or more inner light pipes 1432 and 1433 and converts the photons received by one or more inner light pipes 1432 and 1433 into first multiplied electrons for each packet. Second photo-multiplier tube 1442 is connected to one or more outer light pipes 1431 and 1434 and converts the photons received by one or more outer light pipes 1431 and 1434 into second multiplied electrons for each packet.

Two-channel digitizer 1450 includes a first channel 1451 electrically connected to first photo-multiplier tube 1441 that converts the first multiplied electrons for each ion packet into a first digital value. Two-channel digitizer 1450 includes a second channel 1452 electrically connected to second photo-multiplier tube 1442 that converts the second multiplied electrons for each ion packet into a second digital value.

First channel 1451 and second channel 1452 are independently calibrated to align the first digital value and the second digital value in time and account for the convex shape of the ion impacts of each ion packet.

Returning to FIG. 13, in various embodiments, processor 1340 calculates quantitative information about the ion packets by using intensities of the digital values of the predetermined subset, and using only intensities of the digital values of a remainder of the at least two or more channels at each m/z or time bin that also includes an intensity for digital values of the predetermined subset.

In various embodiments, processor 1340 calculates quantitative information about the ion packets by performing m/z peak finding on the digital values of each of the at least two or more channels after all of ion packets 1301 are received, using intensities of the digital values of the predetermined subset to build the best resolution m/z peak shape, and using intensities of the digital values of the at least two or more channels to calculate a summed intensity for each m/z peak.

In various embodiments, the predetermined subset of one or more channels of the at least two or more channels known to provide the highest resolution is determined during an auto-tune resolution procedure of the TOF mass analyzer. The auto-tune resolution procedure of a TOF mass analyzer is typically run by customers once a week or once a month, for example.

In various embodiments, the predetermined subset includes one channel

In various embodiments, for a four-channel digitizer, as shown in FIG. 13, the predetermined subset includes two channels.

In various embodiments, multichannel digitizer 1330 is electrically connected to the plurality of segmented anode electrode plates to provide a channel for each plate.

In various embodiments, multichannel digitizer 1330 is electrically connected to the plurality of segmented anode electrode plates to provide a channel for two or more plates. U.S. Provisional Application No. 62/470,486, for example, describes a multichannel ion detection system where a multichannel digitizer provides a channel for two segmented anode electrode plates.

Multichannel Ion Detection Method

Figure 15:
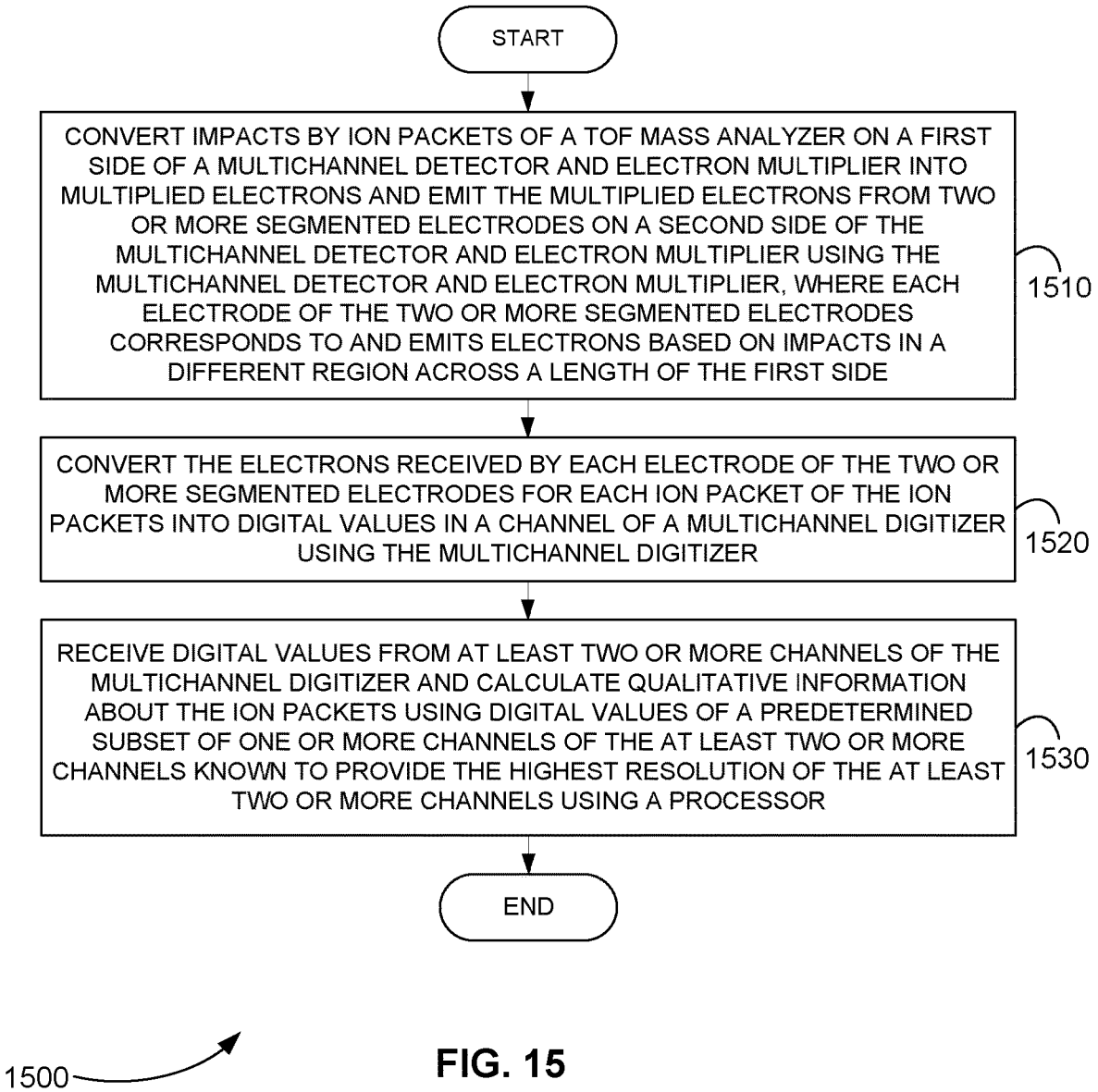
FIG. 15 is an exemplary flowchart showing a method for maintaining a resolution of a TOF mass analyzer despite a loss of resolution in one or more channels of a multichannel ion detection system of the TOF mass analyzer, in accordance with various embodiments.

FIG. 15 is an exemplary flowchart 1500 showing a method for maintaining a resolution of a TOF mass analyzer despite a loss of resolution in one or more channels of a multichannel ion detection system of the TOF mass analyzer, in accordance with various embodiments.

In step 1510 of method 1500, impacts by ion packets of a TOF mass analyzer on a first side of a multichannel detector and electron multiplier are converted into multiplied electrons and the multiplied electrons are emitted from two or more segmented electrodes on a second side of the multichannel detector and electron multiplier using the multichannel detector and electron multiplier. Each electrode of the two or more segmented electrodes corresponds to and emits electrons based on impacts in a different region across a length of the first side.

In step 1520, the electrons received by each electrode of the two or more segmented electrodes for each ion packet of the ion packets are converted into digital values in a channel of a multichannel digitizer using the multichannel digitizer.

In step 1530, digital values from at least two or more channels of the multichannel digitizer are received and qualitative information about the ion packets is calculated using digital values of a predetermined subset of one or more channels of the at least two or more channels known to provide the highest resolution of the at least two or more channels using a processor.

Multichannel Ion Detection Computer Program Product

In various embodiments, computer program products include a tangible computer-readable storage medium whose contents include a program with instructions being executed on a processor so as to perform a method for maintaining a resolution of a TOF mass analyzer despite a loss of resolution in one or more channels of a multichannel ion detection system of the TOF mass analyzer. This method is performed by a system that includes one or more distinct software modules.

Figure 16:
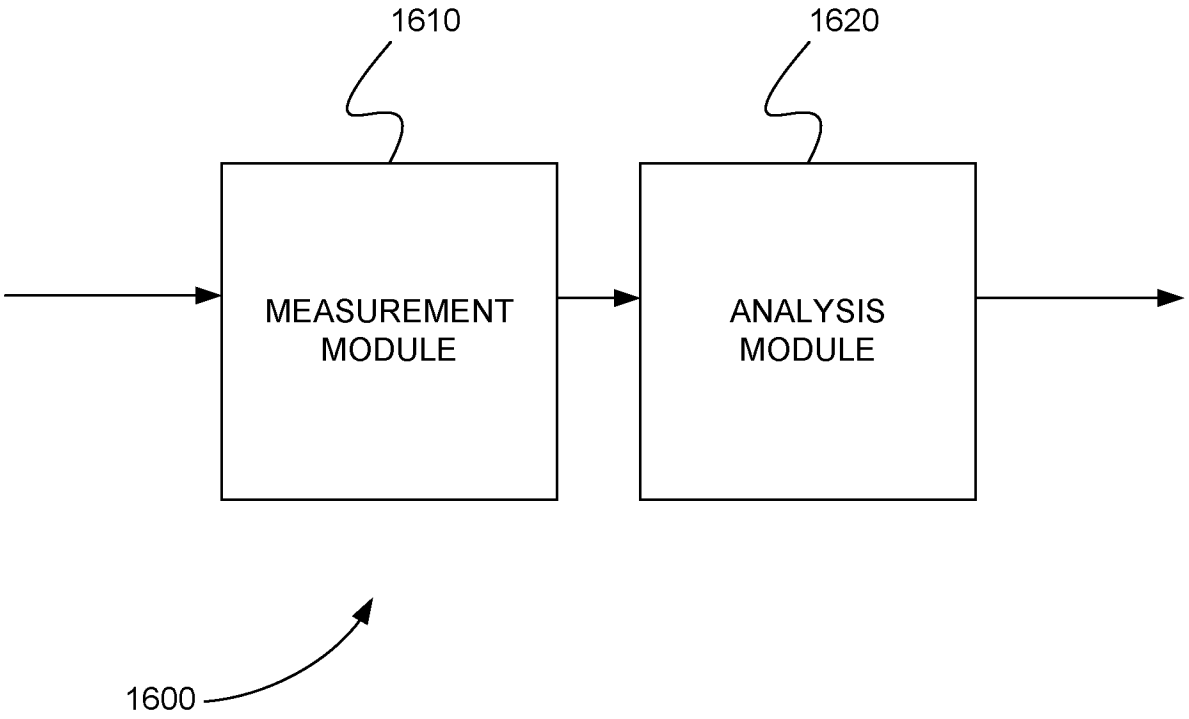
FIG. 16 is a schematic diagram of a system that includes one or more distinct software modules that perform a method for maintaining a resolution of a TOF mass analyzer despite a loss of resolution in one or more channels of a multichannel ion detection system of the TOF mass analyzer, in accordance with various embodiments.

FIG. 16 is a schematic diagram of a system 1600 that includes one or more distinct software modules that perform a method for maintaining a resolution of a TOF mass analyzer despite a loss of resolution in one or more channels of a multichannel ion detection system of the TOF mass analyzer, in accordance with various embodiments. System 1600 includes a measurement module 1610 and an analysis module 1620.

Measurement module 1610 instructs a multichannel detector and electron multiplier to convert impacts by ion packets of a TOF mass analyzer on a first side of the multichannel detector and electron multiplier into multiplied electrons and emit the multiplied electrons from two or more segmented electrodes on a second side of the multichannel detector and electron multiplier. Each electrode of the two or more segmented electrodes corresponds to and emits electrons based on impacts in a different region across a length of the first side.

Measurement module 1610 instructs a multichannel digitizer to convert the electrons received by each electrode of the two or more segmented electrodes for each ion packet of the ion packets into digital values in a channel of the multichannel digitizer.

Analysis module 1620 receives digital values from at least two or more channels of the multichannel digitizer. Analysis module 1620 calculates qualitative information about the ion packets using digital values of a predetermined subset of one or more channels of the at least two or more channels known to provide the highest resolution of the at least two or more channels.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A multichannel ion detection system for a time-of-flight (TOF) mass analyzer that maintains a resolution of the TOF mass analyzer despite a loss of resolution in one or more channels, comprising:

a multichannel detector and electron multiplier that is impacted by ion packets of a TOF mass analyzer on a first side of the multichannel detector and electron multiplier and converts the impacts into multiplied electrons and emits the multiplied electrons from two or more segmented electrodes on a second side of the multichannel detector and electron multiplier, wherein each electrode of the two or more segmented electrodes corresponds to and emits electrons based on impacts in a different region across a length of the first side;

a multichannel digitizer electrically connected to the two or more segmented electrodes that converts the electrons received by each electrode of the two or more segmented electrodes for each ion packet of the ion packets into digital values in a channel of the multichannel digitizer; and a processor that receives digital values from at least two or more channels of the multichannel digitizer and calculates qualitative information about the ion packets using digital values of a predetermined subset of one or more channels of the at least two or more channels known to provide the highest resolution of the at least two or more channels.

2. The system of claim 1, wherein the processor further calculates quantitative information about the ion packets using the at least two or more channels.

3. The system of claim 2, wherein the quantitative information comprises a mass-to-charge ratio (m/z) peak intensity.

4. The system of claim 2, wherein the processor uses digital values from at least two or more channels to calculate quantitative information about the ion packets by using intensities of the digital values of the predetermined subset, and using only intensities of the digital values of a remainder of the at least two or more channels at each mass-to-charge ratio (m/z) bin that also includes an intensity for the digital values of the predetermined subset.

5. The system of claim 2, wherein the processor uses digital values of the at least two or more channels to calculate quantitative information about the ion packets by performing mass-to-charge ratio (m/z) peak finding on the digital values of each of the at least two or more channels after all of the ion packets are received, using intensities of the digital values of the predetermined subset to build a best resolution m/z peak shape, and using intensities of the digital values of the at least two or more channels to calculate a summed intensity for each m/z peak.

6. The system of claim 1, wherein the qualitative information comprises a mass-to-charge ratio (m/z) peak shape.

7. The system of claim 1, wherein the predetermined subset of one or more channels of the at least two or more channels known to provide a highest resolution of the at least two or more channels is determined during an auto-tune resolution procedure of the TOF mass analyzer.

8. The system of claim 1, wherein multichannel detector and electron multiplier is an electrical system or a photoelectrical system.

9. The system of claim 1, wherein the multichannel digitizer comprises a multichannel analog-to-digital converter (ADC).

10. The system of claim 1, wherein the multichannel digitizer comprises a multichannel time-to-digital converter (TDC).

11. The system of claim 1, wherein the predetermined subset includes one channel.

12. The system of claim 1, wherein the multichannel digitizer comprises four channels.

13. The system of claim 12, wherein the predetermined subset includes two channels.

14. A method for maintaining a resolution of a time-of-flight (TOF) mass analyzer despite a loss of resolution in one or more channels of a multichannel ion detection system of the TOF mass analyzer, comprising:

converting impacts by ion packets of a TOF mass analyzer on a first side of a multichannel detector and electron multiplier into multiplied electrons and emitting the multiplied electrons from two or more segmented electrodes on a second side of the multichannel detector and electron multiplier using the multichannel detector and electron multiplier, wherein each electrode of the two or more segmented electrodes corresponds to and emits electrons based on impacts in a different region across a length of the first side;

converting the electrons received by each electrode of the two or more segmented electrodes for each ion packet of the ion packets into digital values in a channel of a multichannel digitizer using the multichannel digitizer; and receiving digital values from at least two or more channels of the multichannel digitizer and calculating qualitative information about the ion packets using digital values of a predetermined subset of one or more channels of the at least two or more channels known to provide the highest resolution of the at least two or more channels using a processor.

15. A computer program product, comprising a non-transitory and tangible computer-readable storage medium whose contents include a program with instructions being executed on a processor so as to perform a method for maintaining a resolution of a time-of-flight (TOF) mass analyzer despite a loss of resolution in one or more channels of a multichannel ion detection system of the TOF mass analyzer, the method comprising:

providing a system, wherein the system comprises one or more distinct software modules, and wherein the distinct software modules comprise a measurement module and an analysis module;

instructing a multichannel detector and electron multiplier to convert impacts by ion packets of a TOF mass analyzer on a first side of the multichannel detector and electron multiplier into multiplied electrons and emit the multiplied electrons from two or more segmented electrodes on a second side of the multichannel detector and electron multiplier using the measurement module, wherein each electrode of the two or more segmented electrodes corresponds to and emits electrons based on impacts in a different region across a length of the first side;

instructing a multichannel digitizer to convert the electrons received by each electrode of the two or more segmented electrodes for each ion packet of the ion packets into digital values in a channel of the multichannel digitizer using the measurement module; and receiving digital values from at least two or more channels of the multichannel digitizer and calculating qualitative information about the ion packets using digital values of a predetermined subset of one or more channels of the at least two or more channels known to provide the highest resolution of the at least two or more channels using the analysis module.

* * * * *